US006315400B1

(12) United States Patent
Sakai et al.

(10) Patent No.: US 6,315,400 B1
(45) Date of Patent: Nov. 13, 2001

(54) INK JET RECORDING HEAD AND INK JET RECORDER

(75) Inventors: Shinri Sakai; Yoshinao Miyata; Tetsushi Takahashi, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/242,964

(22) PCT Filed: Jul. 23, 1998

(86) PCT No.: PCT/JP98/03297

§ 371 Date: Jun. 16, 1999

§ 102(e) Date: Jun. 16, 1999

(87) PCT Pub. No.: WO99/04976

PCT Pub. Date: Feb. 4, 1999

(30) Foreign Application Priority Data

| | | |
|---|---|---|
| Jul. 25, 1997 | (JP) | 9-200652 |
| Sep. 19, 1997 | (JP) | 9-255522 |
| Nov. 26, 1997 | (JP) | 9-324821 |
| Nov. 26, 1997 | (JP) | 9-324822 |
| Jan. 23, 1998 | (JP) | 10-011406 |

(51) Int. Cl.[7] ..... B41J 2/045
(52) U.S. Cl. ..... 347/70; 347/68; 347/71
(58) Field of Search ..... 347/71, 69, 70, 347/68

(56) References Cited

U.S. PATENT DOCUMENTS

| | | | | |
|---|---|---|---|---|
| 5,453,767 | * | 9/1995 | Chang et al. | 347/68 |
| 5,767,612 | * | 6/1998 | Takeuchi et al. | 310/324 |

FOREIGN PATENT DOCUMENTS

| | | | |
|---|---|---|---|
| A1 0 671 772 | 9/1995 | (EP) | H01L/41/09 |
| 4-185348 | 7/1992 | (JP) | B41J/2/16 |
| 5-169654 | 7/1993 | (JP) | B41J/2/045 |
| 5-261921 | 10/1993 | (JP) | B41J/2/045 |
| 5-286131 | 11/1993 | (JP) | B41J/2/045 |
| 5-330069 | 12/1993 | (JP) | B41J/2/16 |
| WO 98/18632 | 5/1998 | (WO) | B41J/2/045 |

OTHER PUBLICATIONS

International Search Report.

* cited by examiner

*Primary Examiner*—Huan Tran
*Assistant Examiner*—An H. Do
(74) *Attorney, Agent, or Firm*—Sughrue, Mion, Zinn, Macpeak & Seas, PLLC

(57) ABSTRACT

The present invention relates to an ink-jet recording head and an ink-jet recording device wherein peeling, a crack etc. at the end of a piezoelectric active part can be prevented. In an ink-jet recording head provided with a diaphragm constituting a part of a pressure generating chamber communicating with a nozzle aperture and a piezoelectric element formed on the diaphragm and provided with the piezoelectric active part of the piezoelectric element in an area opposite to the pressure generating chamber, a vibration regulating part for partially regulating vibration at least in a part of the diaphragm in the vicinity of a boundary with the peripheral wall of the pressure generating chamber is provided.

42 Claims, 28 Drawing Sheets

INK JET RECORDING HEAD AND INK JET RECORDER

BACKGROUND OF THE INVENTION

1. Field of the Invention

The present invention relates to an ink-jet recording head and an ink-jet recording device wherein a piezoelectric element is formed in a part of a pressure generating chamber communicating with a nozzle aperture for jetting an ink droplet via a diaphragm so that an ink droplet is jetted by the displacement of the piezoelectric element.

2. Description of the Related Art

For an ink-jet recording head wherein a part of a pressure generating chamber communicating with a nozzle aperture for jetting an ink droplet is constituted by a diaphragm and an ink droplet is jetted from the nozzle aperture by deforming the diaphragm by a piezoelectric element and pressurizing ink in the pressure generating chamber, two types are used, such as a piezoelectric actuator in a longitudinal vibration mode for extending or contracting a piezoelectric element axially, and a piezoelectric actuator in a flexural vibration mode are used.

For the former, the volume of a pressure generating chamber can be varied by touching the end face of a piezoelectric element to a diaphragm and a head suitable for high density printing can be manufactured. However, on the other hand, there is a problem that a difficult process for cutting a piezoelectric element in the form of the tooth of a comb in accordance with the arrangement pitch of nozzle apertures, and work for positioning and fixing the cut piezoelectric element over a pressure generating chamber are required, and its manufacturing process is complicated.

In the meantime, for the latter, a piezoelectric element can be fixed on a diaphragm in a relatively simple process by sticking a green sheet which is a piezoelectric material in accordance with the shape of a pressure generating chamber and burning it. However, on the other hand, there is a problem that area to some extent is required because flexural vibration is utilized and a high density arrangement is difficult.

In the meantime, to solve the problem of the recording head equivalent to the latter, as disclosed in Japanese published unexamined patent application No. Hei 5-286131, a recording head wherein a piezoelectric element is independently formed for every pressure generating chamber by forming a uniform piezoelectric material layer on the whole surface of a diaphragm by a thin film technique and cutting the piezoelectric material layer in a shape corresponding to each pressure generating chamber by lithography, is proposed.

Accordingly, there is an advantage that work for sticking a piezoelectric element on a diaphragm is not required, and not only a piezoelectric element can be fixed by a precise and convenient method such as lithography, but the piezoelectric element can be thinned and high speed driving is enabled.

In this case, a piezoelectric element corresponding to each pressure generating chamber can be driven by providing at least only an upper electrode for every pressure generating chamber with a piezoelectric material layer provided on the whole surface of a diaphragm. However, it is desirable because of a problem of the quantity of displacement per unit driving voltage and stress upon a piezoelectric layer in a part across a part opposite to a pressure generating chamber and the outside, that a part except at least one end of a piezoelectric layer and an upper electrode respectively constituting a piezoelectric element is not continuously extended outside a pressure generating chamber. However, there is a problem that in such a structure, a crack is readily made in a piezoelectric layer particularly crossing a boundary.

If a substantial driving part of a piezoelectric element is provided apart from over a peripheral wall and corresponding to each pressure generating chamber, structure wherein a piezoelectric element corresponding to each pressure generating chamber is generally covered with an insulating layer, a window (hereinafter called a contact hole) for forming a connection to a lead electrode for supplying voltage for driving each piezoelectric element is provided to the insulating layer corresponding to each pressure generating chamber and the connection of each piezoelectric element and a lead electrode is formed in a contact hole, is proposed. However, the above structure has as a problem that stress is concentrated in the vicinity of a contact hole and breaking and, other problems are readily caused.

For the above ink-jet recording head, to enhance the efficiency of the displacement of a diaphragm by the driving of a piezoelectric element, a structure in which a diaphragm in a part corresponding to both sides of a piezoelectric element is thinned, is proposed. However, when displacement is increased as described above, the above problem is promoted. Further, there is also a problem that breaking such as a crack is readily caused in the vicinity of the peripheral wall of a pressure generating chamber of a diaphragm or in the vicinity of a contact hole.

These problems are readily caused particularly in the case where a piezoelectric material layer is formed by a film forming technique. The reason is that as a piezoelectric material layer formed by film forming technique is very thin, its rigidity is lower, compared with a piezoelectric material layer on which a piezoelectric element is stuck.

SUMMARY OF THE INVENTION

The present invention is made in view of such a situation and the object is to provide an ink-jet recording head and an ink-jet recording device wherein peeling, a crack and other problems in the vicinity of the peripheral wall of a pressure generating chamber of a piezoelectric element and a crack and other problems of a diaphragm are prevented and durability can be secured.

A first embodiment of the present invention to solve the above problems relates to an ink-jet recording head based upon an ink-jet recording head provided with a diaphragm constituting a part of a pressure generating chamber communicating with a nozzle aperture and a piezoelectric element formed on the diaphragm and provided with a piezoelectric active part of the above piezoelectric element in an area opposite to the above pressure generating chamber and characterized in that a vibration regulating part for partially regulating at least a part of the vibration of the above diaphragm is provided in the vicinity of a boundary with the peripheral wall of the above pressure generating chamber.

According to such a first embodiment, the vibration of the diaphragm in the vicinity of a part in which a crack and other problems are readily caused is partially regulated by the vibration regulating part without extremely reducing the whole excluded volume and a crack and peeling are prevented.

A second embodiment of the present invention relates to an ink-jet recording head based upon the first embodiment and characterized in that the above diaphragm is provided with a thin part thinner than the thickness of a part corresponding to the above piezoelectric active part in a part at least on both sides in the direction of the width of the piezoelectric active part and along the edge of the above pressure generating chamber.

According to such a second embodiment, a crack and etc. is prevented from being caused due to the increase of the quantity of displacement by the vibration regulating part because of the thin part.

A third embodiment of the present invention relates to an ink-jet recording head based upon the first or second embodiment and characterized in that the above vibration regulating part is provided outside and on both sides of the end in the longitudinal direction of the above piezoelectric active part.

According to such a third embodiment, vibration at the end of the piezoelectric active part is regulated and a crack and peeling at the end are prevented.

A fourth embodiment of the present invention relates to an ink-jet recording head based upon the second embodiment and characterized in that the above vibration regulating part is provided outside the end in the longitudinal direction of the above piezoelectric active part and the above diaphragm on both sides of the vibration regulating part is the above thin part.

According to such a fourth embodiment, vibration at the end of the piezoelectric active part is regulated and a crack and peeling at the end are prevented.

A fifth embodiment of the present invention relates to an ink-jet recording head based upon the first or second embodiment and characterized in that the above vibration regulating part is provided to a part on both sides in the direction of the width of the above piezoelectric active part.

According to such a fifth embodiment, vibration is regulated in a part of the center of the piezoelectric active part and a crack and peeling at the end are prevented.

A sixth embodiment of the present invention relates to an ink-jet recording head based upon any of the second to fifth embodiments and characterized in that the above vibration regulating part is a thick part thicker than the above thin part in the thickness of the above diaphragm.

According to such a sixth embodiment, the vibration of a piezoelectric actuator is partially regulated by providing a partial thick part.

A seventh embodiment of the present invention relates to an ink-jet recording head based upon any of the first to sixth embodiments and characterized in that the above vibration regulating part is provided with another layer for regulating the vibration of the vibration regulating part.

According to such a seventh embodiment, as another layer is partially provided, the vibration of the piezoelectric actuator is partially regulated.

An eighth embodiment of the present invention relates to an ink-jet recording head based upon any of the first to seventh embodiments and characterized in that the above vibration regulating part is provided with an inactive part provided with an inactive piezoelectric layer on the above diaphragm.

According to such an eighth embodiment, as the inactive piezoelectric layer is partially provided, the vibration of an piezoelectric element is partially regulated.

A ninth embodiment of the present invention relates to an ink-jet recording head based upon the eighth embodiment and characterized in that the above inactive part is a part in which an upper electrode on a piezoelectric layer constituting the above piezoelectric element is removed or a part in which an upper electrode is provided on a piezoelectric layer via an insulating layer.

According to such a ninth embodiment, as the upper electrode is removed or the upper electrode is provided via the insulating layer, the vibration of a piezoelectric actuator is partially regulated.

A tenth embodiment of the present invention relates to an ink-jet recording head based upon the first embodiment and characterized in that the above vibration regulating part is provided in at least a part of the inner edge of a boundary between the above pressure generating chamber and the peripheral wall and is a thick part the whole thickness of which is thicker than the whole thickness around the above piezoelectric active part.

According to such a tenth embodiment, the ink-jet recording head wherein the breaking etc of a diaphragm are prevented owing to the thick part, and the efficiency of displacement and reliability are enhanced, is realized.

An eleventh embodiment of the present invention relates to an ink-jet recording head based upon the tenth embodiment and characterized in that the above thick part is provided on both sides in the direction of the width of the above piezoelectric active part.

According to such an eleventh embodiment, the strength of an arm on both sides of a diaphragm is enhanced owing to the thick part.

A twelfth embodiment of the present invention relates to an ink-jet recording head based upon the tenth or eleventh embodiment and characterized in that the inner edge of the above thick part provided at the corner of the above pressure generating chamber is curved.

According to such a twelfth embodiment, as a corner at the inner edge of the thick part is removed, the generation of a crack and others in a diaphragm in the vicinity of the inner edge is inhibited.

A thirteenth embodiment of the present invention relates to an ink-jet recording head based upon any of the tenth to twelfth embodiments and characterized in that the above thick part is composed of the above diaphragm, the above piezoelectric layer and the above upper electrode.

According to such a thirteenth embodiment, the strength of the diaphragm is enhanced by the diaphragm, the piezoelectric layer and the upper electrode.

A fourteenth embodiment of the present invention relates to an ink-jet recording head based upon any of the tenth to twelfth embodiments and characterized in that the above thick part is composed of the above diaphragm and another layer.

According to such a fourteenth embodiment, the strength of the diaphragm is enhanced by the diaphragm and another layer.

A fifteenth embodiment of the present invention relates to an ink-jet recording head based upon any of the tenth to twelfth embodiments and characterized in that the above thick part is composed of the above diaphragm.

According to such a fifteenth embodiment, durability is enhanced by not thinning the inside of a boundary with the peripheral wall in structure in which an arm is thinned.

A sixteenth embodiment of the present invention relates to an ink-jet recording head based upon any of the tenth to fourteenth embodiments and characterized in that the periphery of the above piezoelectric active part is substantially composed of the above diaphragm.

According to such a sixteenth embodiment, the durability of the diaphragm is enhanced by constituting an arm by only the diaphragm and thickening the inside of a boundary with the peripheral wall, compared with the arm.

A seventeenth embodiment of the present invention relates to an ink-jet recording head based upon any of the tenth to fifteenth embodiments and characterized in that around the above piezoelectric active part, the above diaphragm is substantially relatively thinned.

According to such a seventeenth embodiment, the efficiency of the displacement of the piezoelectric active part is enhanced by thinning the diaphragm in the arm, however, breaking is prevented by the thick part inside a boundary with the peripheral wall.

An eighteenth embodiment of the present invention relates to an ink-jet recording head based upon the seventeenth embodiment and characterized in that the above diaphragm is composed of an elastic film and a lower electrode and the periphery of the above piezoelectric active part is composed of only the above elastic film.

According to such an eighteenth embodiment, the efficiency of the displacement of the piezoelectric active part is enhanced by constituting an arm by only the elastic film and in the meantime, durability is enhanced inside the boundary with the peripheral wall by leaving at least the lower electrode.

A nineteenth embodiment of the present invention relates to an ink-jet recording head based upon the first or second embodiment and characterized in that the above vibration regulating part is provided in a part of an arm along the edge of the above pressure generating chamber on both sides in the direction of the width of the above piezoelectric active part and the vibration of the above diaphragm is regulated by gradually varying the thickness of the above arm.

According to such a nineteenth embodiment, the displacement of the arm is regulated closer to the vibration regulating part by the vibration regulating part the thickness of which is gradually increased and breaking in the vicinity of the vibration regulating part is prevented.

A twentieth embodiment of the present invention relates to an ink-jet recording head based upon the first or second embodiment and characterized in that the above vibration regulating part is provided in a part of an arm along the edge of the above pressure generating chamber on both sides in the direction of the width of the above piezoelectric active part and the vibration of the above diaphragm is regulated by gradually varying the width of the arm.

According to such a twentieth embodiment, the displacement of the arm is regulated closer to the vibration regulating part by the vibration regulating part the width of which is gradually narrowed and breaking in the vicinity of the vibration regulating part is prevented.

A twenty-first embodiment of the present invention relates to an ink-jet recording head based upon the first or second embodiment and characterized in that the above vibration regulating part is provided in a part of an arm along the edge of the above pressure generating chamber on both sides in the direction of the width of the above piezoelectric active part and the vibration of the above diaphragm is regulated by gradually varying the thickness and the width of the arm.

According to such a twenty-first embodiment, the displacement of the arm is regulated toward the end of the pressure generating chamber by the vibration regulating part the thickness of which is gradually increased and the width of which is gradually narrowed and breaking in the vicinity of the end of the pressure generating chamber is prevented.

A twenty-second embodiment of the present invention relates to an ink-jet recording head based upon the twentieth or twenty-first embodiment and characterized in that the width of the above arm is equivalent to distance from the end in the direction of the width of the above piezoelectric active part to a thick part which is provided between adjacent piezoelectric active parts and the thickness of which is thicker than the arm.

According to such a twenty-second embodiment, the width of the vibration regulating part can be varied by varying the width of the piezoelectric active part and the thick part.

A twenty-third embodiment of the present invention relates to an ink-jet recording head based upon any of the nineteenth to twenty-second embodiments and characterized in that the above diaphragm is composed of an elastic film and a lower electrode provided on the elastic film, the above arm is essentially composed of the above elastic film and the above lower electrode and the variation of the thickness of the above vibration regulating part is equivalent to the variation of the thickness of the above piezoelectric layer.

According to such a twenty-third embodiment, the vibration regulating part in which displacement is regulated toward the end is formed by gradually increasing the thickness of the piezoelectric film.

A twenty-fourth embodiment of the present invention relates to an ink-jet recording head based upon any of the nineteenth to twenty-third embodiments and characterized in that the above diaphragm is composed of the above elastic film and a lower electrode provided on the elastic film, the above arm is essentially composed of only the elastic film, the above vibration regulating part is further provided with the above lower electrode and the variation of the thickness of the vibration regulating part is equivalent to the variation of the thickness of the lower electrode.

According to such a twenty-fourth embodiment, the vibration regulating part in which displacement is regulated toward the end is formed by gradually increasing the thickness of the lower electrode.

A twenty-fifth embodiment of the present invention relates to an ink-jet recording head based upon any of the first to twenty-fourth embodiments and characterized in that a piezoelectric layer and an upper electrode constituting the above piezoelectric active part are continuously provided from the end in the longitudinal direction of the piezoelectric active part to an area opposite to the peripheral wall of the above pressure generating chamber and constitute a connecting part, and the above vibration regulating part is provided at least in the vicinity of the above connecting part of the pressure generating chamber.

According to such a twenty-fifth embodiment, displacement in the vicinity of the connecting part is regulated by the vibration regulating part and breaking in the vicinity of the connecting part is prevented.

A twenty-sixth embodiment of the present invention relates to an ink-jet recording head based upon the twenty-fifth embodiment and characterized in that the above connecting part is provided at the end in the longitudinal direction of the above pressure generating chamber.

According to such a twenty-sixth embodiment, breaking in the vicinity of the end in the longitudinal direction of the pressure generating chamber is prevented by the vibration regulating part.

A twenty-seventh embodiment of the present invention relates to an ink-jet recording head based upon any of the first to twenty-fifth embodiments and characterized in that the above piezoelectric active part is provided in an area opposite to the above pressure generating chamber apart from the peripheral wall and provided with a contact which is a connection between a lead electrode for applying voltage to the piezoelectric active part and the piezoelectric active part in an area opposite to the pressure generating chamber, and the above vibration regulating part is provided at least in the vicinity of the above contact of the pressure generating chamber.

According to such a twenty-seventh embodiment, breaking in the vicinity of the contact is prevented by the vibration regulating part.

A twenty-eighth embodiment of the present invention relates to an ink-jet recording head based upon the twenty-seventh embodiment and characterized in that the above contact is provided in the vicinity of the end in the longitudinal direction of the above pressure generating chamber.

According to such a twenty-eighth embodiment, breaking at the end in the vicinity of the contact of the pressure generating chamber is prevented by the vibration regulating part.

A twenty-ninth embodiment of the present invention relates to an ink-jet recording head based upon the twenty-seventh or twenty-eighth embodiment and characterized in that an insulating layer is formed on the upper surface of the above piezoelectric active part and the above contact is formed in a contact hole formed in the insulating layer.

According to such a twenty-ninth embodiment, breaking in the vicinity of the contact hole is prevented by the vibration regulating part.

A thirtieth embodiment of the present invention relates to an ink-jet recording head based upon the first or second embodiment and characterized in that the above piezoelectric layer and the above upper electrode constituting the above piezoelectric active part are continuously provided from the end in the longitudinal direction of the piezoelectric active part to an area opposite to the peripheral wall of the above pressure generating chamber and constitute a connecting part, and the above vibration regulating part is a vibration regulating layer laminated at least on the piezoelectric active part in the vicinity of the following end on the side on which at least the above connecting part is provided at the end in the longitudinal direction of the pressure generating chamber for regulating the vibration of the above diaphragm.

According to such a thirtieth embodiment, the vibration of the diaphragm at the end of the piezoelectric active part or in the connecting part is regulated, and the peeling, a crack etc of the piezoelectric active part and a crack etc of the diaphragm are prevented.

A thirty-first embodiment of the present invention relates to an ink-jet recording head based upon the thirtieth embodiment and characterized in that an insulating layer laminated so that at least the vicinity of the end in the longitudinal direction of the above pressure generating chamber is covered constitutes the above vibration regulating layer.

According to such a thirty-first embodiment, the peeling, a crack etc of the piezoelectric active part in the vicinity of the end in the longitudinal direction of the pressure generating chamber and a crack etc of the diaphragm are prevented by the insulating layer.

A thirty-second embodiment of the present invention relates to an ink-jet recording head based upon the thirtieth or thirty-first embodiment and characterized in that a layer provided at least on the above connecting part of the above piezoelectric active part constitutes the above vibration regulating layer.

According to such a thirty-second embodiment, the peeling, a crack etc of the piezoelectric active part in a part corresponding to the connecting part and a crack etc of the diaphragm are prevented.

A thirty-third embodiment of the present invention relates to an ink-jet recording head based upon the thirty-second embodiment and characterized in that the above vibration regulating layer is constituted by increasing the thickness of the above upper electrode, compared with the other part.

According to such a thirty-third embodiment, vibration is regulated by increasing the thickness of the upper electrode, compared with the other part, and the peeling, a crack etc of the piezoelectric active part and a crack etc of the diaphragm are prevented.

A thirty-fourth embodiment of the present invention relates to an ink-jet recording head based upon any of the thirtieth to thirty-third embodiments and characterized in that in the above connecting part, both the above piezoelectric layer and the above upper electrode are formed so that they are narrower than the main part of the above piezoelectric active part.

According to such a thirty-fourth embodiment, stress in the connecting part is reduced and breaking such as a crack is prevented.

A thirty-fifth embodiment of the present invention relates to an ink-jet recording head based upon any of the thirtieth to thirty-fourth embodiments and characterized in that in the above connecting part, only the above upper electrode is formed so that it is narrower than the main part of the above piezoelectric active part.

According to such a thirty-fifth embodiment, stress in the connecting part is reduced, breaking such as a crack is prevented and durability is enhanced.

A thirty-sixth embodiment of the present invention relates to an ink-jet recording head based upon any of the thirtieth to thirty-fifth embodiments and characterized in that a contact for connecting a lead electrode for applying voltage to the above piezoelectric active part and the above upper electrode is provided in a part opposite to the peripheral wall of the above pressure generating chamber.

According to such a thirty-sixth embodiment, breaking such as a crack in the contact is prevented.

A thirty-seventh embodiment of the present invention relates to an ink-jet recording head based upon any of the first to thirty-sixth embodiments and characterized in that the above pressure generating chamber is formed by anisotropically etching a silicon monocrystalline substrate and each layer of the above piezoelectric element is formed by a film forming method and lithography.

According to such a thirty-seventh embodiment, the ink-jet recording head provided with nozzle apertures at high density can be relatively readily manufactured in large quantity.

A thirty-eighth embodiment of the present invention relates to an ink-jet recording device characterized in that the ink-jet recording device is provided with the ink-jet recording head according to any of the first to thirty-seventh embodiments.

According to such a thirty-eighth embodiment, the inkjet recording device wherein the durability of the head is enhanced and the reliability is enhanced can be realized.

DESCRIPTION OF THE PREFERRED EMBODIMENTS

The present invention will be described in detail based upon embodiments below.

First Embodiment

Figure 1:
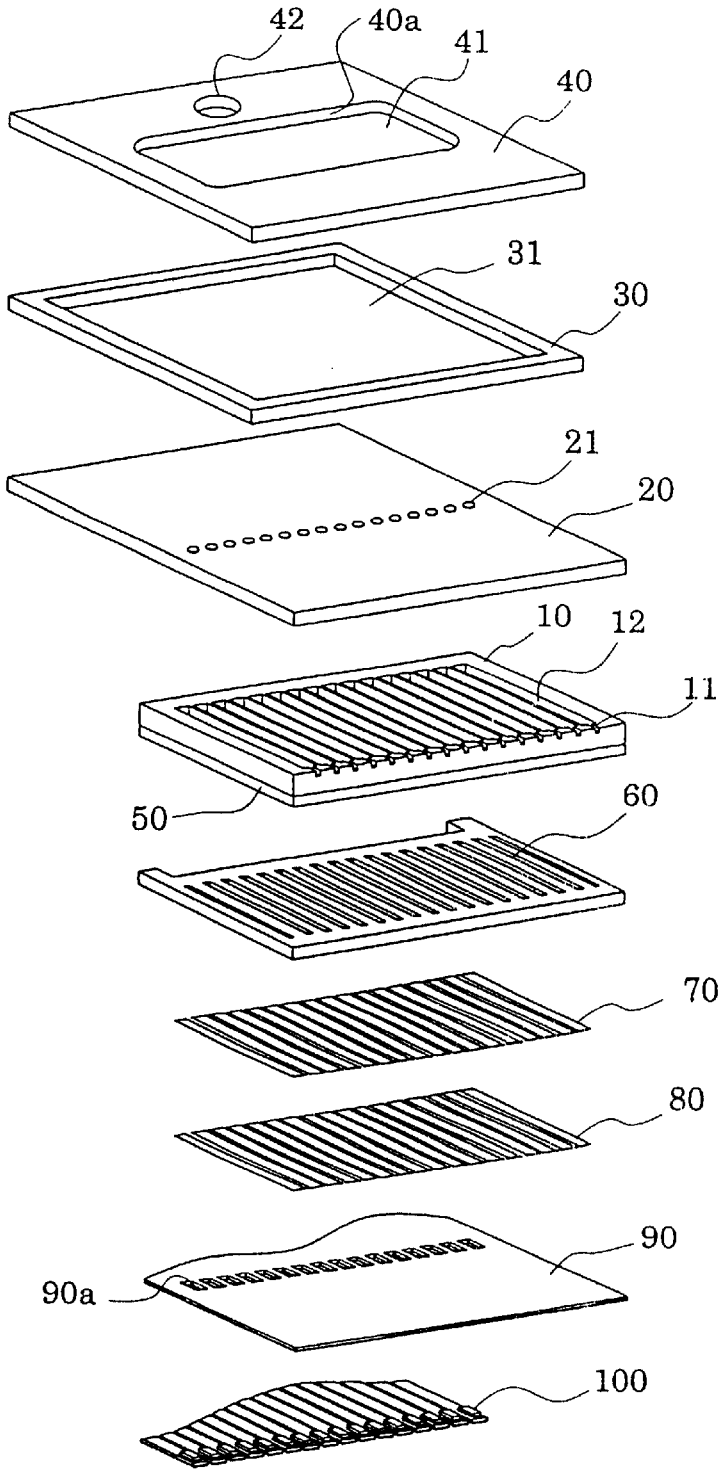
FIG. 1 is an exploded perspective view showing an inkjet recording head equivalent to a first embodiment of the present invention.
Figure 2A:
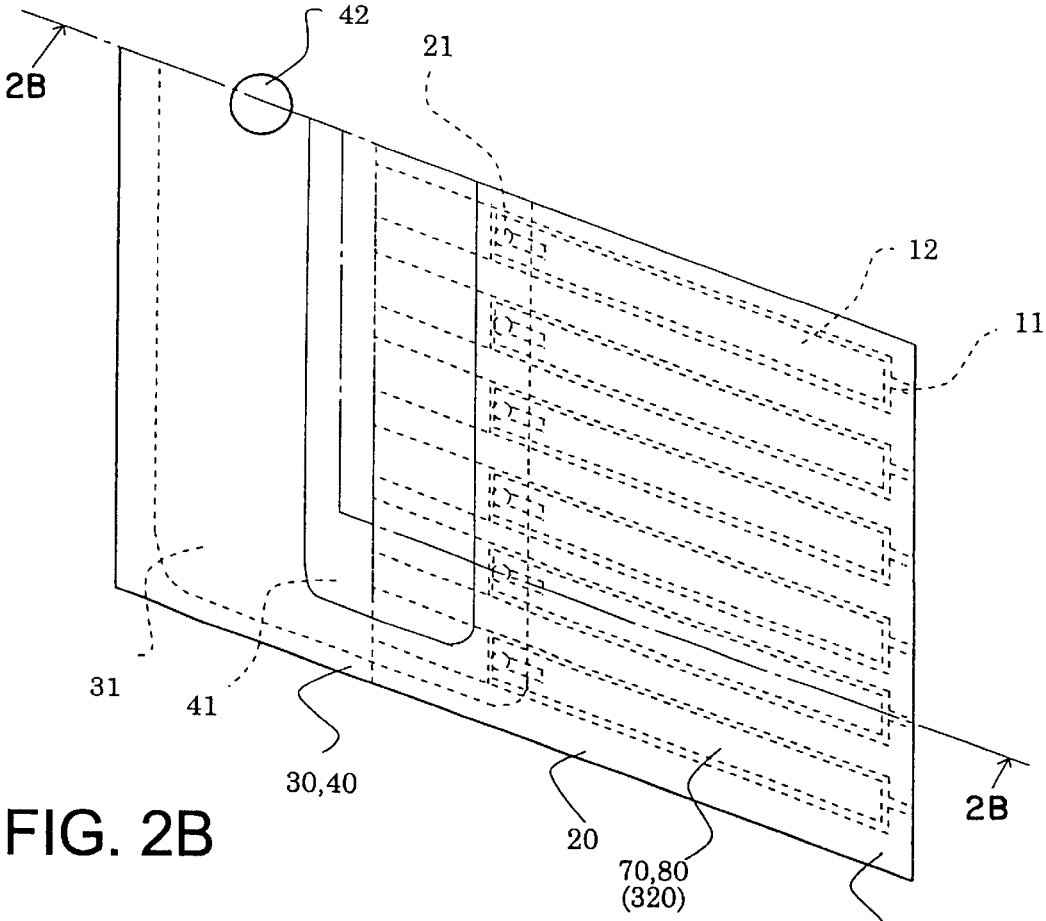
FIGS. 2(*a*) and 2(*b*) show the ink-jet recording head equivalent to the first embodiment of the present invention and are a plan of FIG. 1 and a sectional view.
Figure 2B:
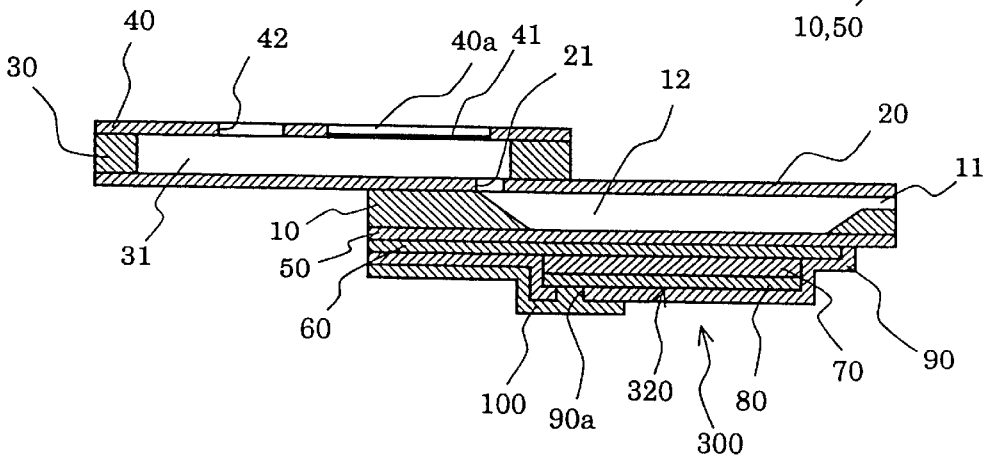

FIG. 1 is an exploded perspective view showing an ink-jet recording head equivalent to a first embodiment of the present invention and FIGS. 2A and 2B show a plan and the sectional structure in the longitudinal direction of one pressure generating chamber.

As shown in these drawings, a passage forming substrate 10 is composed of a silicon monocrystalline substrate with the face orientation of (110) in this embodiment. For the passage forming substrate 10, normally, a substrate with the thickness of approximately 150 to 300 μm is used, and desirably, a substrate with the thickness of approximately 180 to 280 μm and preferably, a substrate with the thickness of approximately 220 μm are suitable. This is because the arrangement density can be enhanced, keeping the rigidity of a partition between adjacent pressure generating chambers.

One face of the passage forming substrate 10 is open and an elastic film 50 with the thickness of 1 to 2 μm composed of silicon dioxide and formed by thermal oxidation beforehand is formed on the other surface of the passage forming substrate 10.

In the meantime, a nozzle aperture 11, a pressure generating chamber 12 are formed on the open face of the passage forming substrate 10 by anisotropically etching the silicon monocrystalline substrate.

Anisotropic etching is executed utilizing a character that when a silicon monocrystalline substrate is dipped in alkaline solution such as KOH, it is gradually eroded, a first face (111) perpendicular to a face (110) and a second face (111) at an angle of approximately 70° with the first face (111) and at an angle of approximately 35° with the face (110) emerge and the etching rate of the face (111) is approximately 1/180, compared with the etching rate of the face (110). By such anisotropic etching, precise processing can be executed based upon the processing in the depth of a parallelogram formed by the two first faces (111) and the two diagonal second faces (111) and the pressure generating chambers 12 can be arranged in high density.

In this embodiment, the longer side of each pressure generating chamber 12 is formed by the first face (111) and the shorter side is formed by the second face (111). The pressure generating chamber 12 is formed by etching the passage forming substrate up to the elastic film 50 approximately through the passage forming substrate 10. The elastic film 50 is eroded in extremely small quantity in alkaline solution for etching the silicon monocrystalline substrate.

In the meantime, each nozzle aperture 11 communicating with one end of each pressure generating chamber 12 is formed so that it is narrower and shallower than the pressure generating chamber 12. That is, the nozzle aperture 11 is formed by etching halfway in the direction of the thickness of the silicon monocrystalline substrate (half-etching). Half-etching is executed by adjusting etching time.

The size of the pressure generating chamber 12 for applying pressure for jetting an ink droplet to ink and the size of the nozzle aperture 11 for jetting an ink droplet are optimized according to the quantity of ink droplets to be jetted, jetting speed and a jetting frequency. For example, if 360 ink droplets are recorded per inch, the nozzle aperture 11 is required to be formed precisely so that it is a few tens $\mu$m wide.

Each pressure generating chamber 12 and a common ink chamber 31 described later communicate via an ink supply communicating port 21 respectively formed in a position corresponding to one end of each pressure generating chamber 12 of a sealing plate 20 described later, ink is supplied from the common ink chamber 31 via the ink supply communicating port 21 and distributed to each pressure generating chamber 12.

Figure 3A:
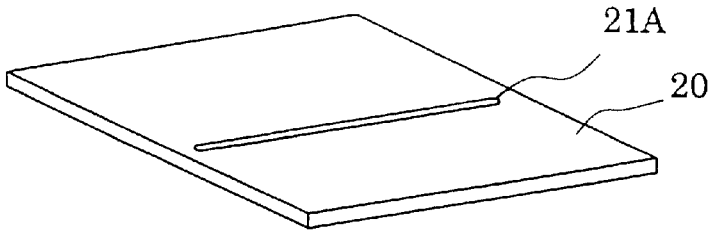
FIGS. 3(*a*) and 3(*b*) show an example in which a sealing plate shown in FIG. 1 is transformed.
Figure 3B:
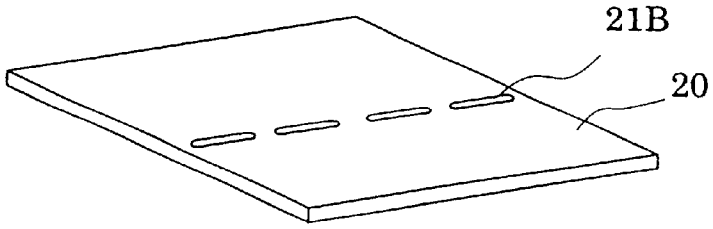
Figure 4A:
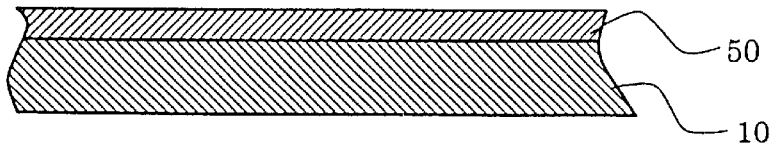
FIGS. 4(*a*)–4(*d*) show a thin film manufacturing process in the first embodiment of the present invention.
Figure 4B:
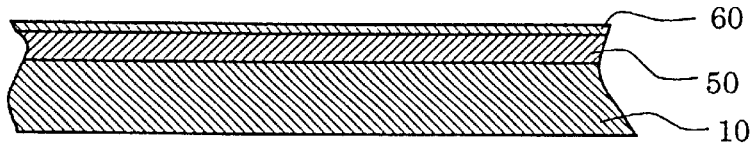
Figure 4C:
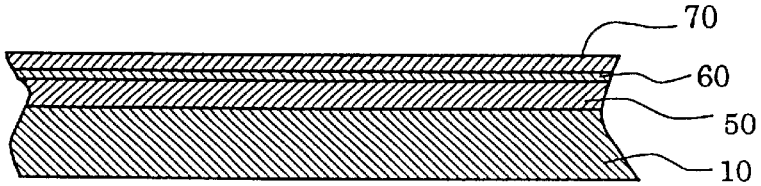
Figure 4D:
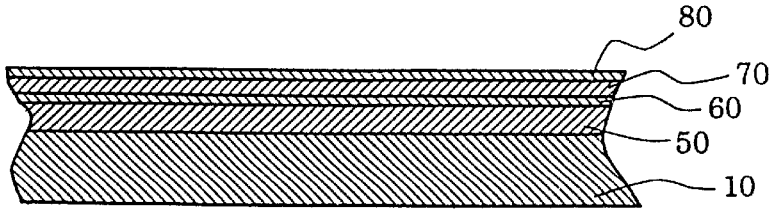

The sealing plate 20 is composed of glass ceramics through which the above ink supply communicating port 21 corresponding to each pressure generating chamber 12 is made, the thickness of which is 0.1 to 1 mm for example and the coefficient of linear expansion of which is 2.5 to 4.5 [$\times 10^{-6}$/°C.] at 300° C. or less for example. The ink supply communicating port 21 may be also one slit 21A or plural slits 21B which respectively cross the vicinity of the end on the side of ink supply of each pressure generating chamber 12 as shown in FIGS. 3(*a*) and 3(*b*). One surface of the sealing plate 20 covers one surface of the passage forming substrate 10 overall and the sealing plate also functions as a reinforcing plate for protecting the silicon monocrystalline substrate from shock and external force. The other surface of the sealing plate 20 constitutes one wall of the common ink chamber 31.

A common ink chamber forming substrate 30 forms the peripheral walls of the common ink chamber 31 and is produced by punching a stainless steel plate with suitable thickness according to the number of nozzle apertures and an ink droplet jetting frequency. In this embodiment, the thickness of the common ink chamber forming substrate 30 is set to 0.2 mm.

An ink chamber side plate 40 is composed of a stainless steel substrate and one surface constitutes one wall of the common ink chamber 31. In the ink chamber side plate 40, a thin wall 41 is formed by forming a concave portion 40*a* by applying half-etching to a part of the other surface and further, an ink inlet 42 through which ink is supplied from the outside is formed by punching. The thin wall 41 is formed to absorb pressure to the reverse side to the nozzle aperture 11 which is generated when an ink droplet is jetted and prevents unnecessary positive or negative pressure from being applied to another pressure generating chamber 12 via the common ink chamber 31. In this embodiment, in view of rigidity required when the ink inlet 42 and external ink supply means are connected and others, the thickness of the ink chamber side plate 40 is set to 0.2 mm and the thin wall 41 0.02 mm thick is formed in a part, however, the thickness of the ink chamber side plate 40 maybe also set to 0.02 mm from the beginning to omit the formation of the thin wall 41 by half-etching.

In the meantime, a lower electrode film 60 with the thickness of approximately 0.5 $\mu$m for example, a piezoelectric film 70 with the thickness of approximately 1 $\mu$m for example and an upper electrode film 80 with the thickness of approximately 0.1 $\mu$m for example are laminated on the elastic film 50 on the reverse side to the open face of the passage forming substrate 10 in a process described later and constitute a piezoelectric element 300. The piezoelectric element 300 includes the lower electrode film 60, the piezoelectric film 70 and the upper electrode film 80. Generally, either electrode of the piezoelectric element 300 is used as a common electrode, and the other electrode and the piezoelectric film 70 are constituted by patterning them every pressure generating chamber 12. A part which is composed of either electrode and the piezoelectric film 70 respectively patterned and in which piezoelectric distortion is caused by applying voltage to both electrodes is called a piezoelectric active part 320. In this embodiment, the lower electrode film 60 functions as a common electrode of the piezoelectric element 300 and the upper electrode film 80 functions as an individual electrode of the piezoelectric element 300, however, even if these are reversed for the convenience of a driving circuit and wiring, no problem occurs. In any case, the piezoelectric active part is formed for every pressure generating chamber. Here, the piezoelectric element 300 and a diaphragm displaced by driving the piezoelectric element 300 are called a piezoelectric actuator as a whole. In the above example, the elastic film 50 and the lower electrode film 60 act as a diaphragm, however, the lower electrode film may also function as the elastic film.

An insulating layer 90 provided with insulation is formed at least at the edge of the upper surface of each upper electrode film 80 and on the side of the piezoelectric film 70. It is desirable that the insulating layer 90 is formed by a film forming method or formed by material which can be reshaped by etching, for example silicon oxide, silicon nitride and organic material, desirably photosensitive polyimide the rigidity of which is low and which is excellent in insulation.

A contact hole 90*a* for exposing a part of the upper electrode film 80 to connect to a lead electrode 100 described later is formed in a part of the insulating layer 90 covering the upper surface of a part corresponding to one end of each upper electrode film 80. The lead electrode 100 one end of which is connected to each upper electrode film 80 via the contact hole 90*a* and the other end of which is extended to a connecting terminal is formed. The lead electrode 100 is formed so that it is as narrow as possible to the extent that a driving signal can be securely supplied to the upper electrode film 80.

Referring to FIGS. 4, a process for forming the piezoelectric film 70 and others over the passage forming substrate 10 composed of a silicon monocrystalline substrate will be described below.

As shown in FIG. 4(*a*), first, a wafer of a silicon monocrystalline substrate to be the passage forming substrate 10 is thermally oxidized in a diffusion furnace heated approximately at 1100° C. and the elastic film 50 composed of silicon dioxide is formed.

Next, as shown in FIG. 4(*b*), the lower electrode film 60 is formed by sputtering. For the material of the lower electrode film 60, platinum (Pt) is suitable. This is because the piezoelectric film 70 formed by sputtering and so-gel transformation and described later is required to be crystallized by burning the formed piezoelectric film at the temperature of approximately 600 to 1000° C. under the atmosphere of the air or oxygen. That is, the material of the lower electrode film 60 is required to keep conductivity under such high-temperature and oxidizing atmosphere, it is desirable that particularly, if lead zirconate titanate (PZT) is used for the piezoelectric film 70, conductivity is hardly varied by the diffusion of PbO and Pt is suitable for these reasons.

Next, as shown in FIG. 4(*c*), the piezoelectric film 70 is formed. Sputtering may be also used for forming the piezoelectric film 70, however, in this embodiment, so-called sol-gel transformation wherein so-called sol in which a metallic organic substance is dissolved and dispersed in a solvent is applied, dried and gels and further, the piezoelectric film 70 composed of metallic oxide is obtained by burning it at high temperature is used. For the material of the piezoelectric film 70, PZT is desirable if it is used for an ink-jet recording head.

Next, as shown in FIG. 4(*d*), the upper electrode film 80 is formed. The material of the upper electrode film 80 has only to be very conductive material and many metals such as Al, Au, Ni and Pt, conductive oxide and others can be used. In this embodiment, the upper electrode film is formed using Pt by sputtering.

Figure 5A:
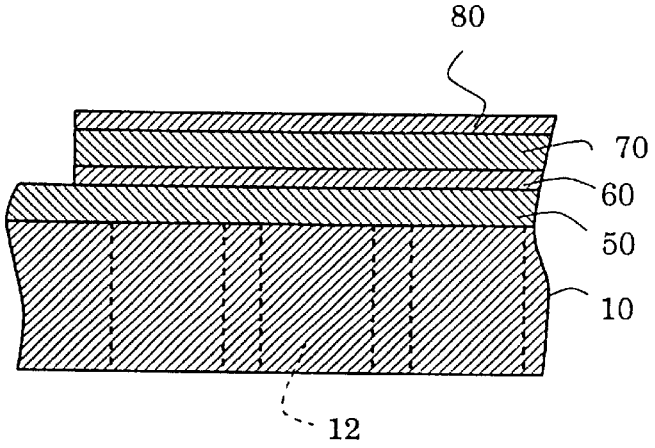
FIGS. 5(*a*)–5(*c*) show the thin film manufacturing process in the first embodiment of the present invention.
Figure 5B:
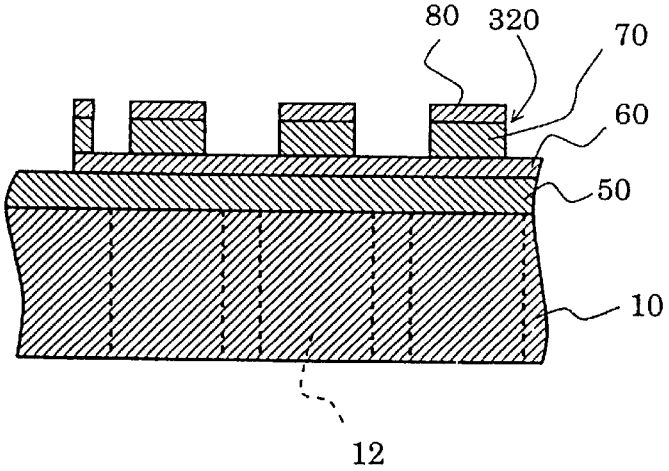
Figure 5C:
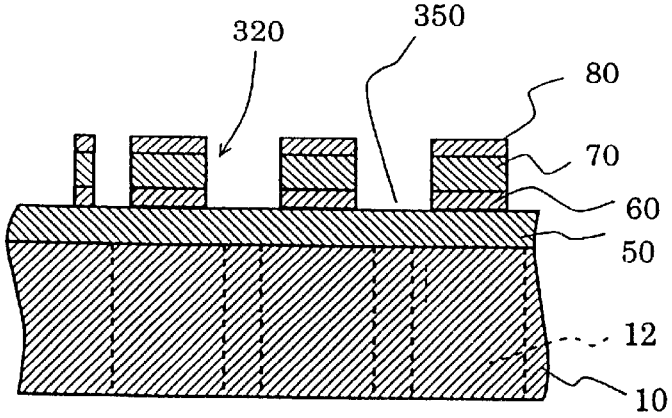
Figure 6A:
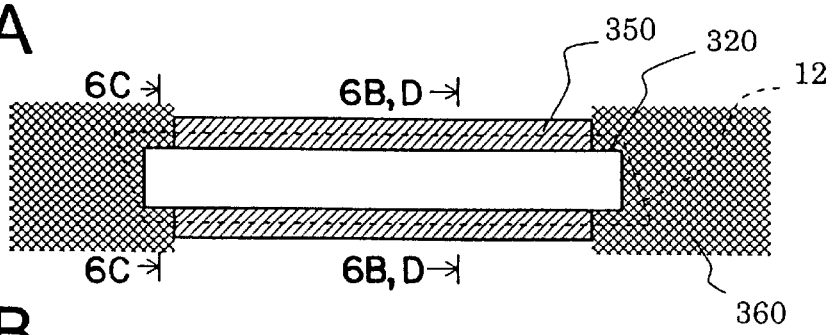
FIGS. 6(*a*)–6(*d*) are a plan and sectional views respectively showing the main part of the ink-jet recording head equivalent to the first embodiment of the present invention.
Figure 6B:
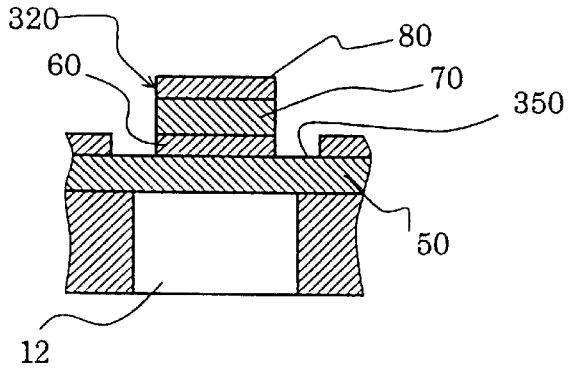
Figure 6C:
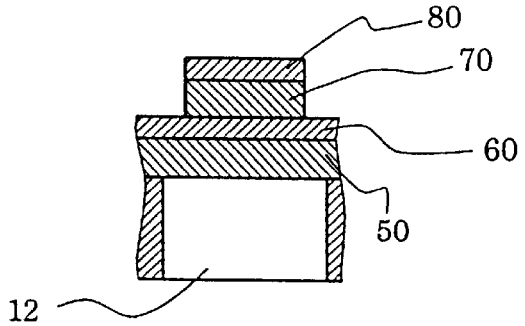
Figure 6D:
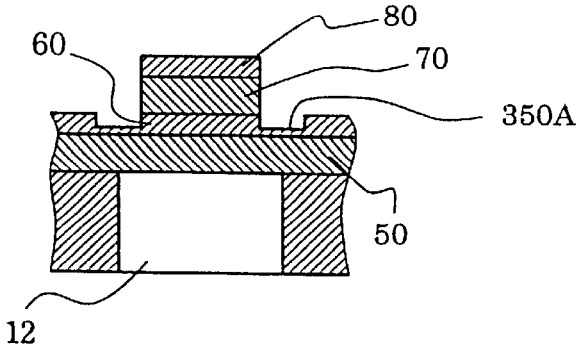

Next, as shown in FIGS. 5, the lower electrode film 60, the piezoelectric film 70 and the upper electrode film 80 are patterned.

First, as shown in FIG. 5(*a*), the lower electrode film 60, the piezoelectric film 70 and the upper electrode film 80 are etched together and patterned in accordance with the whole pattern of the lower electrode film 60. Next, as shown in FIG. 5(*b*), only the piezoelectric film 70 and the upper electrode film 80 are etched and the piezoelectric active part 320 is patterned. Next, as shown in FIG. 5(*c*), a lower electrode film removed part 350 is formed by removing the lower electrode film 60 in a part equivalent to the arm of the diaphragm on both sides of the piezoelectric active part 320 which is an area opposite to each pressure generating chamber 12 (FIGS. 5 show a state before the pressure generating chamber 12 is formed and it is shown by a broken line). As described above, as the lower electrode film removed part 350 is provided, displaced the quantity can be increased by applying voltage to the piezoelectric active part 320.

As described above, patterning is completed by first forming the whole pattern of the lower electrode film 60, next patterning the piezoelectric active part 320 and finally patterning the lower electrode film removed part 350.

FIGS. 6 show planar positional relationship between the piezoelectric active part 320 and the lower electrode film removed part 350 respectively formed as described above.

As shown in FIG. 6(*a*), the piezoelectric active part 320 composed of the piezoelectric film 70 and the upper electrode film 80 is provided in an area opposite to the pressure generating chamber 12 and the lower electrode film removed part 350 is provided next to both sides in the direction of the width of the piezoelectric active part 320. A part in which the lower electrode film removed part 350 is provided is a part called the arm of the diaphragm, is a part opposite to the vicinity of the edge on both sides in the direction of the width of the pressure generating chamber 12 and the lower electrode film 60 on both sides of piezoelectric active part 320 is removed as shown in a section viewed along a line 6B—6B in FIG. 6(*b*). In this embodiment, the lower electrode film removed part 360 is formed an except a part adjacent to both ends of the piezoelectric active part 320. Therefore, in an area opposite to both ends in the longitudinal direction of the pressure generating chamber 12, the lower electrode film 60 exists on both sides in the direction of the width of and outside in the longitudinal both ends of the piezoelectric active part 320 as shown in a section viewed along a line 6C—6C in FIG. 6(*c*), forms a thick part 360 the thickness which is relatively thick and functions as a vibration regulating part for partially regulating the vibration of the diaphragm As the vibration by the application of voltage of the diaphragm is regulated, the displaced quantity is relatively reduced only in the vicinity of both ends of the piezoelectric active part 320 and, the displaced quantity at the end can be inhibited without greatly deteriorating the whole displaced quantity owing to such, a structure, and peeling, a crack etc at the end of the piezoelectric active part 320 can be prevented. The thick part 360 may be also provided at one end of the pressure generating chamber 12.

In this embodiment, the lower electrode film removed part 350 is formed by completely removing the lower electrode film 60, however, as shown in FIG. 6(*d*), a lower electrode film removed part 350A may be also formed by removing a part in the thickness of the lower electrode film 60 by half-etching and others. In this case, no elastic film 50 is formed and the lower electrode film 60 may also function as an elastic body and a lower electrode.

As described above, after the lower electrode film 60 etc is patterned, desirably, the insulating layer 90 provided with insulation is formed so that it covers at least the edge of the upper surface of each upper electrode film 80 and the sides of the piezoelectric film 70 and the lower electrode film 60 (see FIG. 1).

Next, the contact hole 90*a* for exposing a part of the upper electrode film 80 to connect to the lead electrode 100 described later is formed in a part of a part covering the upper surface of a part corresponding to one end of each piezoelectric active part 320 of the insulating layer 90. The lead electrode 100 one end of which is connected to each upper electrode film 80 via the contact hole 90*a* and the other end of which is extended to a connecting terminal is formed. The lead electrode 100 is formed so that it is as narrow as possible to the extent that a driving signal can be securely supplied to the upper electrode film 80.

Figure 7A:
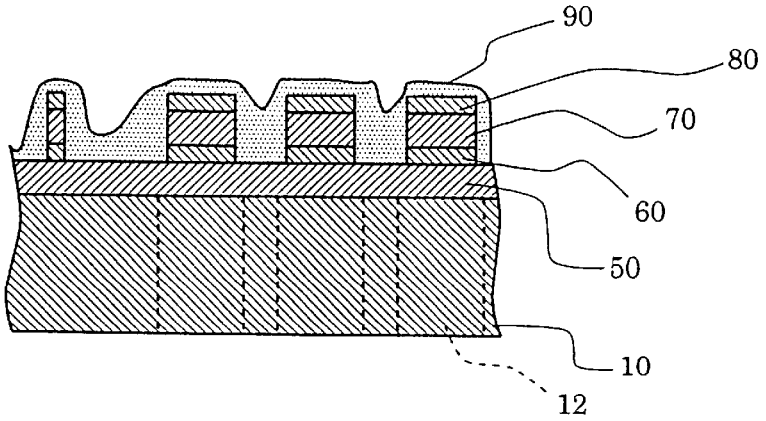
FIGS. 7(*a*)–7(*c*) show a process for forming an insulation layer in the first embodiment of the present invention.
Figure 7B:
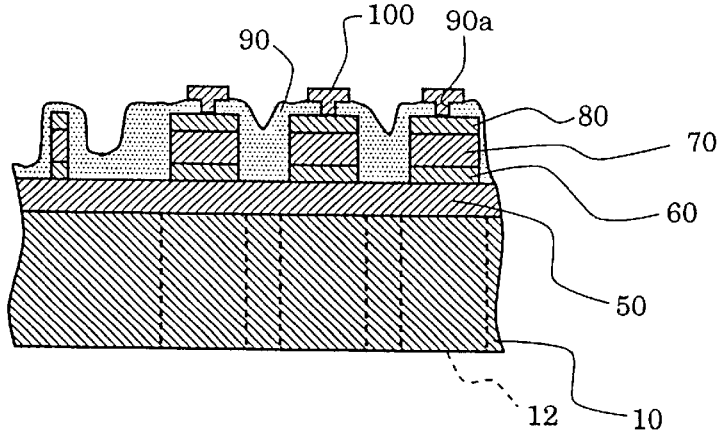
Figure 7C:
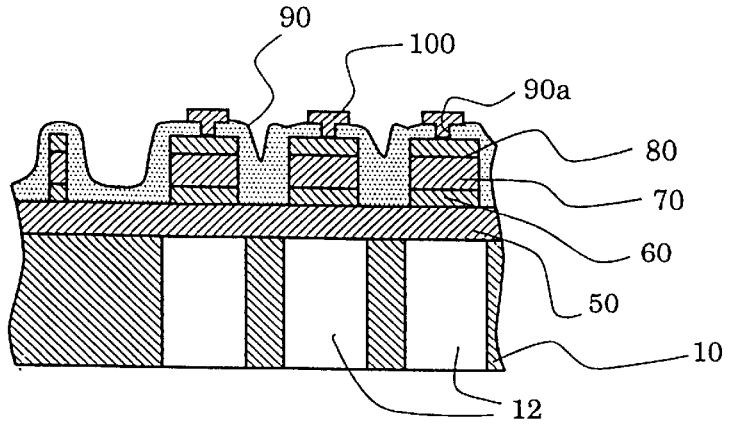

FIGS. 7 show a process for forming such an insulating layer.

First, as shown in FIG. 7(*a*), the insulating layer 90 is formed so that the edge of the upper electrode film 80 and the respective sides of the piezoelectric film 70 and the lower electrode film 60 are covered. The suitable material of the insulating layer 90 is described above, however, in this embodiment, negative photosensitive polyimide is used.

Next, as shown in FIG. 7(*b*), the contact hole 90*a* is formed in a part corresponding to the vicinity of the end on the side of ink supply of each pressure generating chamber 12 by patterning the insulating layer 90. The contact hole 90*a* has only to be provided to a part corresponding to the piezoelectric active part 320 and for example, may be also provided in the center and at the end on the side of a nozzle.

Next, the lead electrode 100 is formed by patterning after conductive material such as Cr—Au is formed on the overall surface.

The above is the film forming process. After the film is formed as described above, the anisotropic etching of the silicon monocrystalline substrate is executed using the above alkaline solution as shown in FIG. 7(*c*) and the pressure generating chamber 12 and others are formed. In the above series of the formation of films and anisotropic etching, multiple chips are simultaneously formed on one wafer and after a process is finished, the one wafer is divided into every passage forming substrate 10 in one chip size shown in FIG. 1. The sealing plate 20, the common ink chamber forming substrate 30 and the ink chamber side plate 40 are sequentially bonded to the divided passage forming substrate 10 and integrated to be an ink-jet recording head.

In the ink-jet recording head constituted as described above, ink is taken in from the ink inlet 42 connected to external ink supply means not shown, after the inside from the common ink chamber 31 to the nozzle aperture 11 is filled with ink, voltage is applied between the lower electrode film 60 and the upper electrode film 80 via the lead electrode 100 according to a recording signal from an external driving circuit not shown. Pressure in the pressure generating chamber 12 is increased by flexuously deforming the elastic film 50, the lower electrode film 60 and the piezoelectric film 70, and an ink droplet is jetted from the nozzle aperture 11.

Second Embodiment

Figure 8:
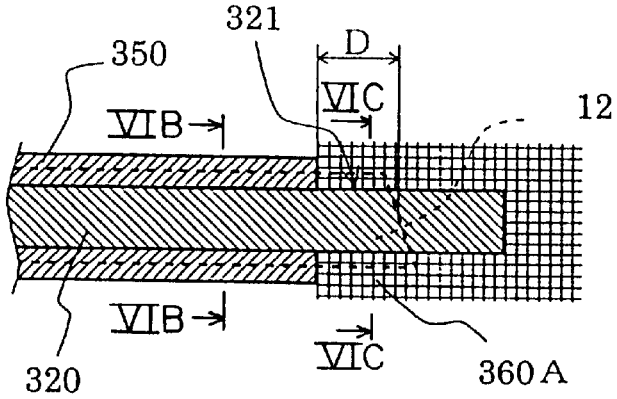
FIG. 8 is a plan showing the main part of an ink-jet recording head equivalent to a second embodiment of the present invention.

FIG. 8 shows each shape of a piezoelectric active part and a pressure generating chamber of an ink-jet recording head equivalent to a second embodiment.

In the above embodiment, the piezoelectric active part 320 is formed in an area opposite to the pressure generating chamber 12 apart from over the peripheral wall of the pressure generating chamber 12. However, this embodiment is the same as the first embodiment except that a piezoelectric film 70 and an upper electrode 80 constituting a piezoelectric active part 320 are continously extended up to over a peripheral wall and constitute a connecting part 321. A thick part 360A composed of a lower electrode film 60 which is relatively thick is provided on both sides in the direction of the width of the piezoelectric active part 320 and the connecting part 321 at the end of a pressure generating chamber 12 in the vicinity of the connecting art 321. In this case, the vicinity of an area D shown in FIG. 8 functions as a vibration regulating part. That is, a section viewed along VI B and a section viewed along a line VI C are respectively similar to sectional views in FIGS. 6(*b*) and 6(*c*), a lower electrode film removed part 350 is formed on both sides of the piezoelectric active part 320, the lower electrode film 60 is formed on both sides at the end of the piezoelectric active part 320 and constitutes the thick part 360A.

In such a constitution, as deflection is slowly generated in the pressure generating chamber 12 when a piezoelectric element is driven and toward the pressure generating chamber from a boundary with its peripheral wall, the stress of the piezoelectric active part 320 located in the vibration regulating part is reduced, and breaking such as a crack is prevented and durability is enhanced. To produce such an effect, it is desirable that the length of the vibration regulating part, that is, distance (the area D in FIG. 8) from the end of the lower electrode film removed part 350 to the end of the pressure generating chamber 12 in this embodiment is ½ of the width of the pressure generating chamber 12 or more.

Third Embodiment

Figure 9A:
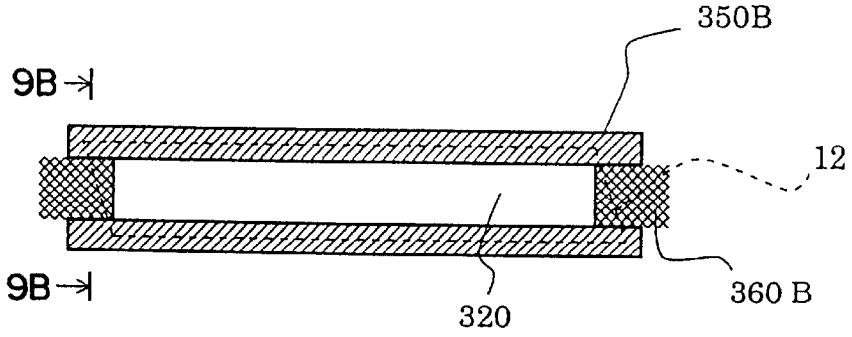
FIGS. 9(*a*) and 9(*b*) are a plan and a sectional view respectively showing the main part of an ink-jet recording head equivalent to a third embodiment of the present invention.
Figure 9B:
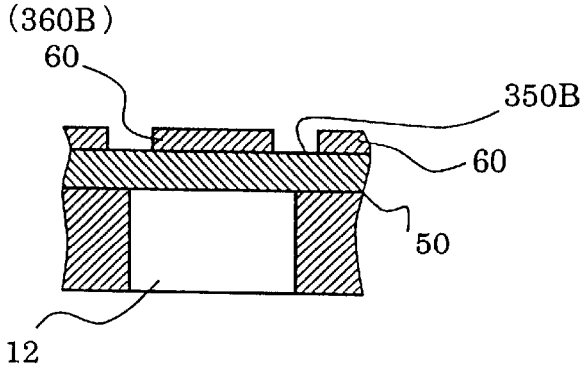

FIGS. 9 show each shape of a piezoelectric active part and a pressure generating chamber of an ink-jet recording head equivalent to a third embodiment of the present invention.

This embodiment is the same as the first embodiment except that a lower electrode film removed part 350B is formed not up to both ends of the piezoelectric active part 320 but up to the outside in the longitudinal direction. Therefore, at the end of the pressure generating chamber 12, a part held between the lower electrode film removed parts 350B is a thick part 360B.

Therefore, owing to such, a structure, vibration due to the application of voltage is regulated only in the vicinity of both ends of the piezoelectric active part 320 as in the first embodiment, the displaced quantity is relatively reduced, the displaced quantity at the end can be inhibited without greatly reducing, the displaced quantity as a whole and peeling, a crack etc at the end of the piezoelectric active part 320 can be prevented. The thick part 360B may be also provided at one end of the pressure generating chamber 12.

Fourth Embodiment

Figure 10A:
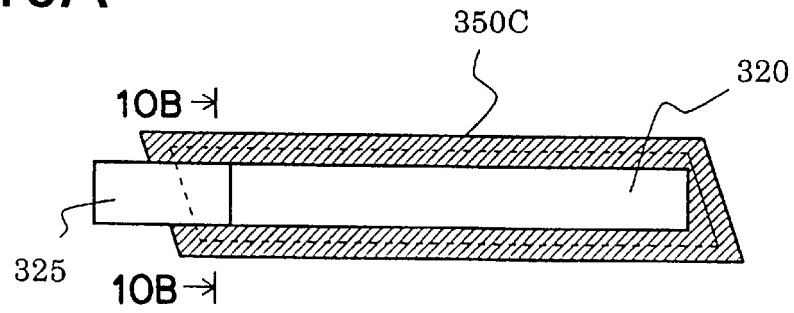
FIGS. 10(*a*)–10(*c*) are a plan and sectional views respectively showing the main part of an ink-jet recording head equivalent to a fourth embodiment of the present invention.
Figure 10B:
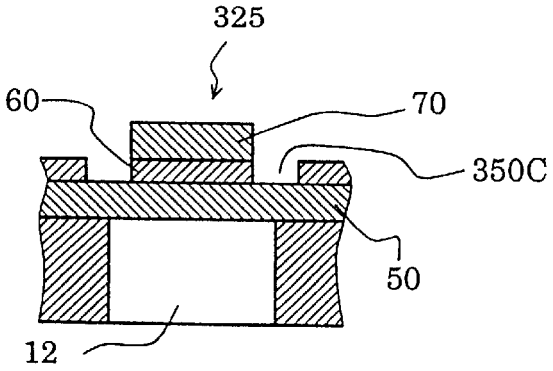
Figure 10C:
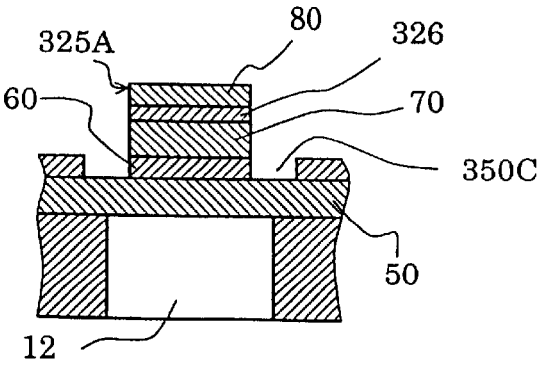

FIGS. 10 show each shape of a piezoelectric active part and a pressure generating chamber of an ink-jet recording head equivalent to a fourth embodiment of the present invention.

This embodiment is different from the above embodiments and a lower electrode film removed part 350C is provided in the shape of reverse C along three edges except one end of the pressure generating chamber 12. Further, a piezoelectric film 70 and an upper electrode 80 constituting the piezoelectric active part 320 are continuously extended up to over a peripheral wall from one end at which the lower electrode film removed part 350C is not provided. However, a part extended from over the vicinity of the peripheral wall up to over the peripheral wall is not merely a thick part but an inactive piezoelectric active part 325.

The inactive piezoelectric active part 325 has a structure composed of only a lower electrode film 60 and the piezoelectric film 70 as shown in a section viewed along a line 10B—10B in FIG. 10(*b*) wherein the upper electrode 80 is removed. Therefore, even if voltage is applied to the piezoelectric active part 320, the inactive piezoelectric active part is not driven.

Owing to such, a structure, vibration due to the application of voltage is regulated in only the vicinity of the inactive piezoelectric active part 325, the displaced quantity is relatively reduced, the displaced quantity at the end can be inhibited without greatly reducing, the displaced quantity as a whole and peeling, a crack etc at the end of the piezoelectric active part 320 can be prevented. The inactive piezoelectric active part 325 may be also provided at both ends of the pressure generating chamber 12.

As shown in FIG. 10(*c*), an inactive piezoelectric active part 325A may be also formed by providing an insulating layer 326 between the piezoelectric film 70 and the upper electrode film 80.

Fifth Embodiment

Figure 11A:
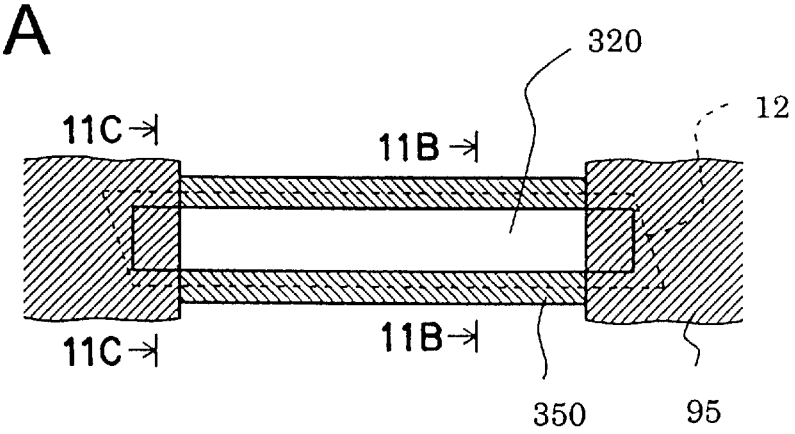
FIGS. 11(*a*)–11(*c*) are a plan and sectional views respectively showing the main part of an ink jet recording head equivalent to a fifth embodiment of the present invention.
Figure 11B:
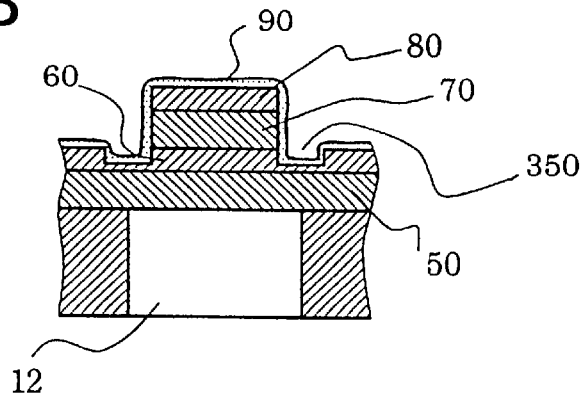
Figure 11C:
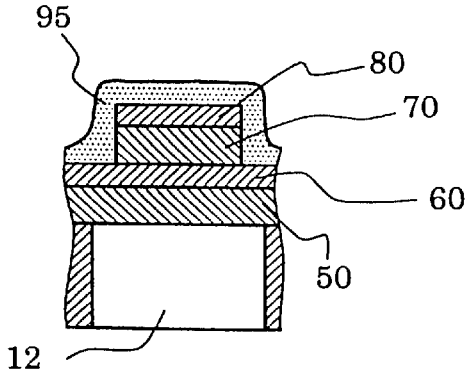

FIGS. 11 show each shape of a piezoelectric active part and a pressure generating chamber of an ink-jet recording head equivalent to a fifth embodiment of the present invention.

This embodiment is the same as the first embodiment except that the thick part 95 of an insulating layer 90 is provided as a vibration regulating part in place of the thick part 360 in the first embodiment.

That is, in a part except both ends of the piezoelectric active part 320, the insulating layer 90 with normal thickness is provided on an upper electrode film 80 as shown in a section viewed along a line 11B—11B in FIG. 11(*b*). However, at both ends, a thick insulating layer 95 is provided on the upper electrode film 80 as shown in a section viewed along a line 11C—11C in FIG. 11(*c*).

Therefore, when voltage is applied to the piezoelectric active part 320 and it is driven, vibration is regulated only at both ends, the displaced quantity is relatively reduced in only the vicinity of the part, the displaced quantity at the end can be inhibited without greatly reducing the displaced quantity as a whole and peeling, a crack etc at the end of the piezoelectric active part 320 can be prevented.

The thick insulating layer 95 may be also provided at only one end of the pressure generating chamber 12. The thick insulating layer 95 has only to be relatively thickened, compared with the other part and for example, another layer may be also provided on the insulating layer 90.

Sixth Embodiment

Figure 12:
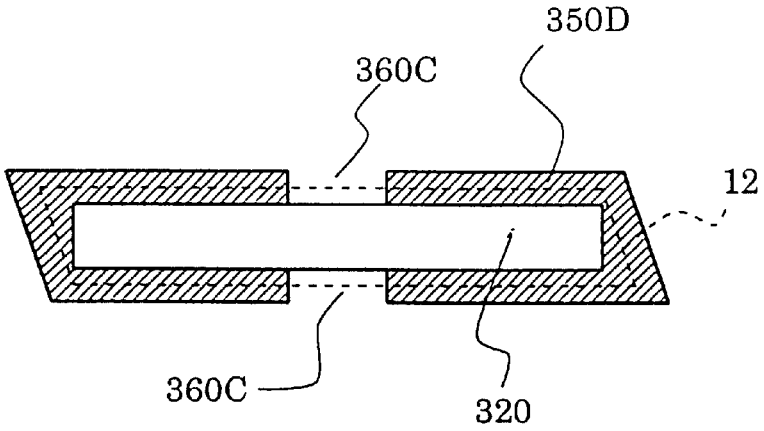
FIG. 12 is a plan showing the main part of an ink-jet recording head equivalent to a sixth embodiment of the present invention.

FIG. 12 shows each shape of a piezoelectric active part and a pressure generating chamber of an ink-jet recording head equivalent to a sixth embodiment of the present invention.

This embodiment is the same as the first embodiment except that the thick part 360C of a lower electrode film 60 is provided on both sides of approximately the center in the longitudinal direction of the piezoelectric active part 320 and a lower electrode film removed part 350D in the shape of reverse C is formed along the edge of the pressure generating chamber 12 except the above center.

Therefore, owing to such structure, as in the first embodiment, as vibration by the application of voltage is regulated so that it does not exceed the required quantity in approximately the center of the piezoelectric active part 320, peeling, a crack etc at the end of the piezoelectric active part 320 can be prevented without greatly reducing the displaced quantity as a whole.

Seventh Embodiment

Figure 13A:
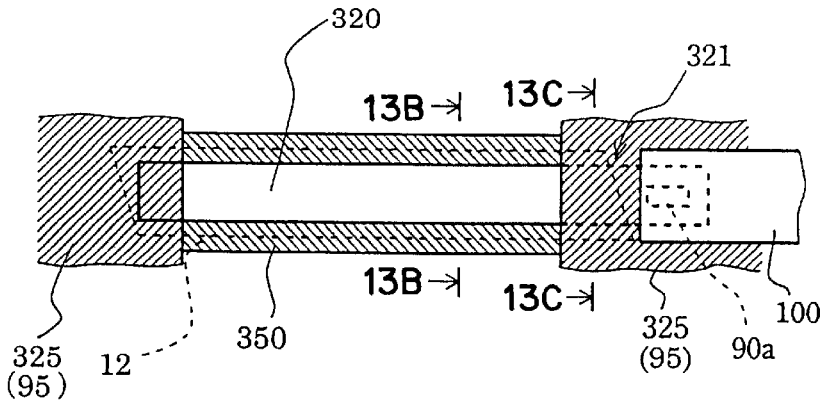
FIGS. 13(*a*)–13(*c*) are a plan and sectional views respectively showing the main part of an ink-jet recording head equivalent to a seventh embodiment of the present invention.
Figure 13B:
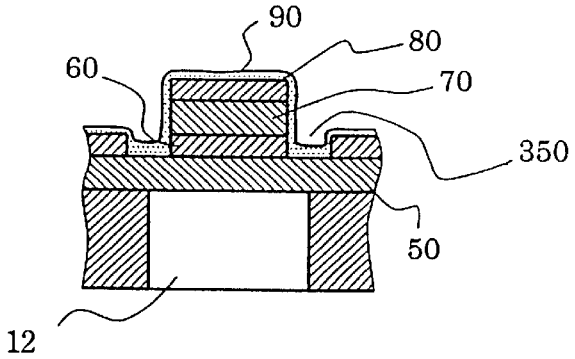
Figure 13C:
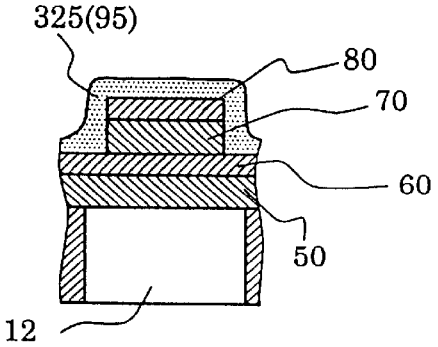

FIGS. 13 are a plan showing a main part in a seventh embodiment and the sectional view. Basic constitution in this embodiment resembles that in the second embodiment and a connecting part 321 in which a piezoelectric film 70 and an upper electrode 80 constituting a piezoelectric active part 320 are continuously extended from over one end in the longitudinal direction of a pressure generating chamber 12 up to over its peripheral wall, is provided.

As shown in FIG. 13(*a*), the piezoelectric active part 320 composed of the piezoelectric film 70 and the upper electrode film 80 is basically provided in an area opposite to the pressure generating chamber 12 and formed so that the piezoelectric active part has a slightly narrower width than the width of the pressure generating chamber 12. At one end of the pressure generating chamber 12, the piezoelectric film 70 and the upper electrode film 80 are continuously extended from an area opposite to the pressure generating chamber 12 to an area opposite to the peripheral wall and the vicinity of a boundary between the area opposite to the pressure generating chamber 12, and the area opposite to the peripheral wall is the connecting part 321.

In this embodiment, both ends in the longitudinal direction of the piezoelectric active part 320 and the whole connecting part 321 are covered with an insulating layer 90. The insulating layer 90 with normal thickness is formed on the piezoelectric active part 320 in the area opposite to the pressure generating chamber 12 as shown in a section viewed along a line 13B—13B in FIG. 13(*c*) so as to function as a vibration regulating layer 325 for regulating the vibration of a diaphragm. A contact hole 90*a* for connecting a lead electrode 100 and the ipper electrode film 80 is formed in the thick insulating layer 95 in a position corresponding to the piezoelectric film 70 and the upper electrode film 80 and continously extended by the connecting part 321.

As described above, a part opposite to the vicinity of a boundary with the peripheral wall on both sides in the direction of the width of the pressure generating chamber 12 and on both sides of the piezoelectric active part 320, that is, a lower electrode film 60 in a part equivalent to the arm of a diaphragm is removed and a lower electrode film removed part 350 is formed.

Owing to such a constitution, when voltage is applied to the piezoelectric active part 320 to drive the part, driving only at both ends and in the connecting part 321 is regulated, only in the vicinity of these parts, the displaced quantity is relatively reduced, displaced the quantity at the end can be inhibited without greatly reducing, the displaced quantity as a whole and peeling, a crack etc at the end of the piezoelectric active part 320 and a crack etc of the diaphragm can be prevented.

The thick insulating layer 95 is provided at both ends of the piezoelectric active part 320 and on the connecting part 321. In this embodiment, however, it may be also provided only on the side of the connecting part 321. The thick insulating layer 95 has only to be relatively thicker than the other part. Therefore, another layer may be also laminated on the insulating layer 90 and the insulating layer with normal thickness may be also provided only in the thick insulating layer 95.

Eighth Embodiment

Figure 14A:
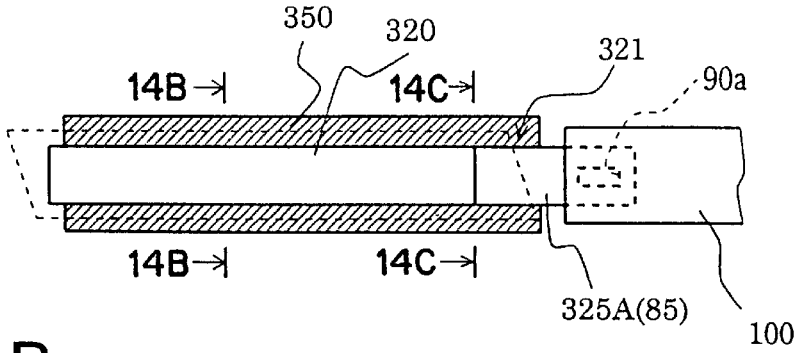
FIGS. 14(*a*)–14(*c*) are a plan and sectional views respectively showing the main part of an ink-jet recording head equivalent to an eighth embodiment of the present invention.
Figure 14B:
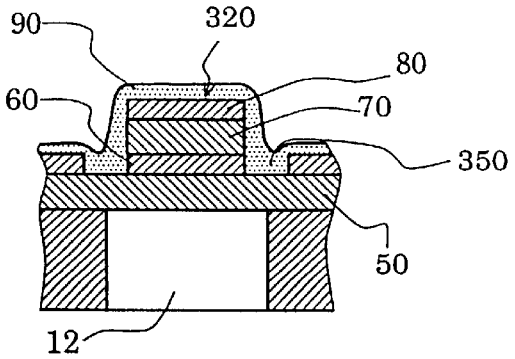
Figure 14C:
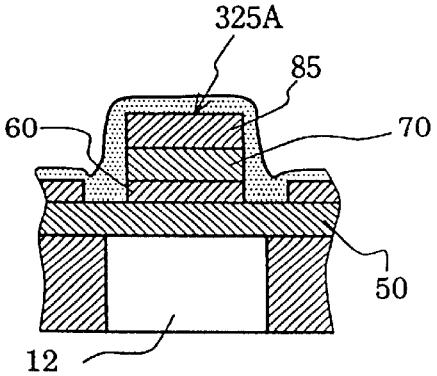

FIGS. 14 are a plan and sectional views respectively showing the main part of an ink-jet recording head equivalent to an eighth embodiment of the present invention.

This embodiment is the same as the seventh embodiment except that a thick part 85 thicker than an upper electrode film 80 in the other part is formed on a piezoelectric film 70 in an area opposite to the boundary and the peripheral wall of a pressure generating chamber 12 as a vibration regulating layer 325A and in an area opposite to the area of the pressure generating chamber 12, the vibration of a diaphragm is regulated.

As shown in FIG. 14(*a*), a piezoelectric active part 320 is basically provided in an area opposite to the pressure generating chamber 12 as in the seventh embodiment, at one end of the pressure generating chamber 12, the piezoelectric film 70 and the upper electrode film 80 are continuously extended from an area opposite to the pressure generating chamber 12 to an area opposite to the peripheral wall and constitute a connecting part 321. An insulating layer 90 is formed on the piezoelectric active part 320 and the connecting part 321 and a contact hole 90*a* for connecting a lead electrode 100 and the upper electrode film 80 is formed in the insulating layer 90 in an area opposite to the peripheral wall. A lower electrode film 60 in a part equivalent to the arm of a diaphragm is removed and a lower electrode film removed part 350 is formed.

The upper electrode film 80 is formed so that it has normal thickness in an area opposite to the pressure generating chamber 12 as shown in a section viewed along a line 14B—14B in FIG. 14(*b*). However, in the connecting part 321 and the area opposite to the peripheral wall, the upper electrode film becomes the thick part 85 thicker than in the other part as shown in a section viewed along a line 14C—14C in FIG. 14(*c*) and constitutes the vibration regulating layer 325A.

Owing to such constitution, the similar effect to that in the seventh embodiment can be produced.

The thick part 85 is formed on the piezoelectric film 70 in the connecting part 321 and the area opposite to the peripheral wall in this embodiment. However, if the thick part is formed on the piezoelectric film 70 at least in the connecting part 321, similar effect can be obtained.

The thick insulating layer 95 described in the seventh embodiment may be further provided to a constitution in this embodiment and hereby, and a further remarkable effect is produced.

Ninth Embodiment

Figure 15:
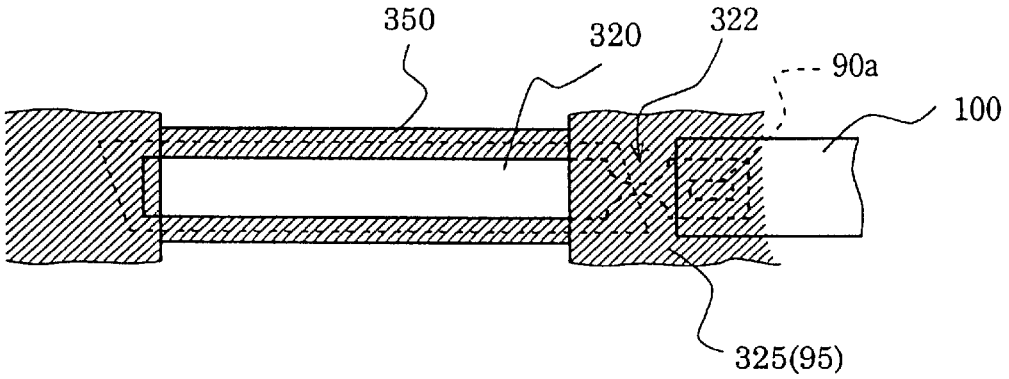
FIG. 15 is a plan showing the main part of an ink-jet recording head equivalent to a ninth embodiment of the present invention.

FIG. 15 shows the pattern form of a piezoelectric active part and others in the vicinity of a pressure generating chamber of an ink-jet recording head equivalent to a ninth embodiment of the present invention.

This embodiment is the same as the seventh embodiment except that a connecting part 322 which is a part that a piezoelectric film 70 and an upper electrode film 80 constituting the piezoelectric active part 320 cross from an area opposite to the pressure generating chamber 12 to an area opposite to its peripheral wall is narrower than the other part as shown in FIG. 15. In the connecting part 322 in this embodiment, both the piezoelectric film 70 and the upper electrode film 80 are formed so that they are narrow.

Owing to such a constitution, as the vibration of a diaphragm is inhibited in the connecting part 322 and the area opposite to the peripheral wall because of an insulating layer thick part 95 when the piezoelectric active part 320 is driven and in addition, deflection is slowly generated in the pressure generating chamber 12 and from a boundary with the peripheral wall toward the pressure generating chamber 12, stress in the connecting part 322 is reduced, and breaking such as a crack, is prevented and durability is enhanced.

Tenth Embodiment

Figure 16:
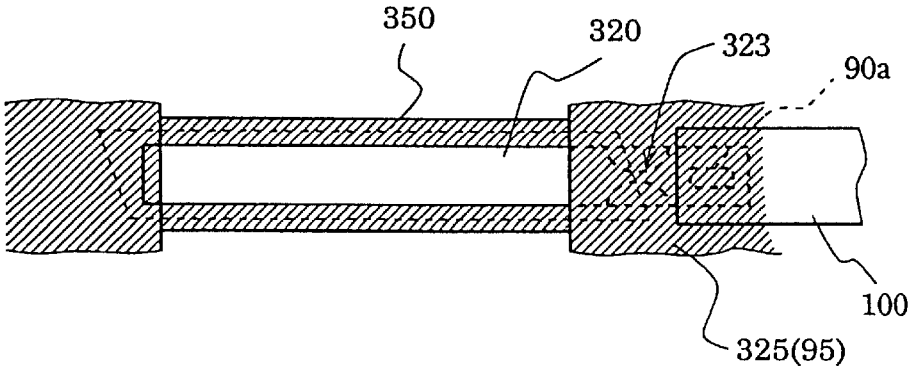
FIG. 16 is a plan showing the main part of an ink-jet recording head equivalent to a tenth embodiment of the present invention.
Figure 17A:
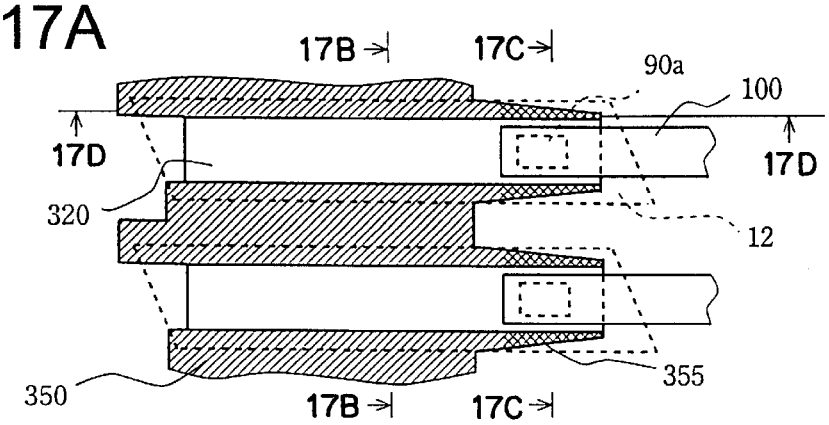
FIGS. 17(*a*)–17(*d*) are a plan and sectional views respectively showing the main part of an ink-jet recording head equivalent to an eleventh embodiment of the present invention.
Figure 17B:
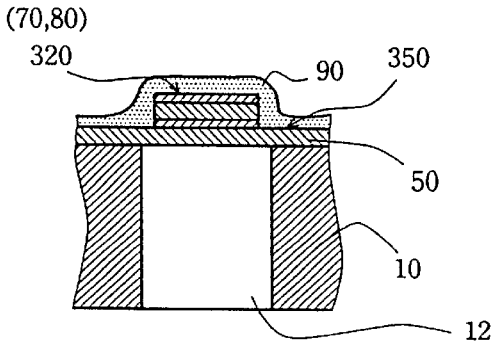
Figure 17C:
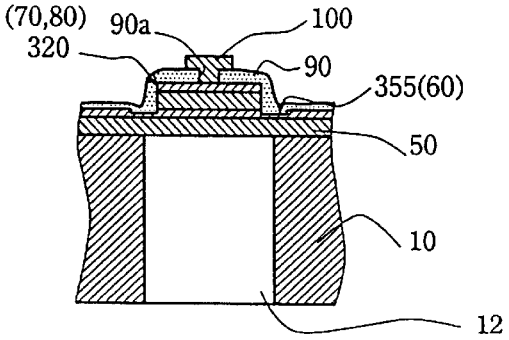
Figure 17D:
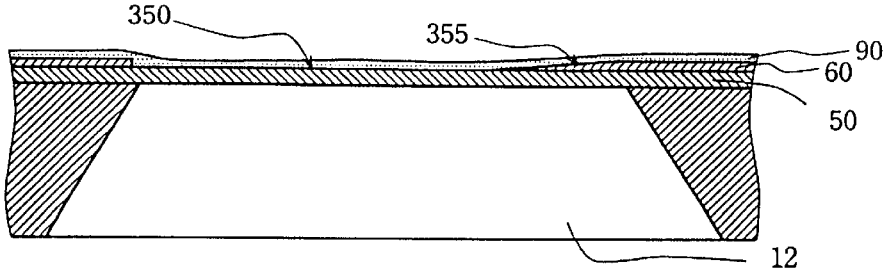

FIG. 16 shows the pattern form of a piezoelectric active part and others in the vicinity of a pressure generating chamber of an ink-jet recording head equivalent to a tenth embodiment of the present invention.

This embodiment is the same as the ninth embodiment except that only an upper electrode film 80 is formed so that it is narrow in the vicinity of a connecting part 323 as shown in FIG. 16 and a piezoelectric film 70 has the same thickness as the other part.

According to such a constitution, a similar effect to that in the ninth embodiment can be also produced.

Eleventh Embodiment

FIGS. 17 show a planar positional relationship between a piezoelectric active part 320 and a lower electrode film removed part 350 respectively in the vicinity of a pressure generating chamber of an ink-jet recording head equivalent to an eleventh embodiment of the present invention. As the basic structure in this embodiment is similar to that in the first embodiment, the same reference number is allocated to a member showing the same action and the description is omitted.

As shown in FIG. 17(*a*), the piezoelectric active part 320 composed of a piezoelectric film 70 and an upper electrode film 80 is provided in an area opposite to a pressure generating chamber 12 apart from its peripheral wall and the lower electrode film removed art 350 is provided next to both sides in the direction of the piezoelectric active part 320. A part in which the lower electrode film removed part 350 is provided is a part called an arm, is a part opposite to the vicinity of the edge along both sides in the direction of the width of the pressure generating chamber 12 and as shown in FIG. 17(*b*) which is a section viewed along a line 17B—17B in FIG. 17(*a*), a lower electrode film 60 on both sides of the piezoelectric active part 320 is removed. Therefore, a diaphragm in the lower electrode film removed part 350 is composed of only an elastic film 50 and the thickness is relatively reduced, compared with the thickness of the other area so that the diaphragm is readily deformed. Needless, the lower electrode film remvoed part 350 may be also formed by removing only a part in the direction of the thickness of the electrode film 60 by half-etching and other and a part in the direction of the thickness of the elastic film 50 may also be removed.

In this embodiment, in the lower electrode film removed part 350, a vibration regulating part 355 which gradually becomes narrower and gradually becomes thicker respectively toward the end is formed over the vicinity of the end over which contact hole 90*a* is formed of the pressure generating chamber 12 as shown in FIG. 17(*a*), FIG. 17(*c*) which is a section viewed along a line 17C—17C and FIG. 17(*d*) which is a section viewed along a line 17D—17D. Therefore, the diaphragm on the part in the vicinity of the end is harder to be deformed than the other lower electrode film removed part 350.

Figure 18A:
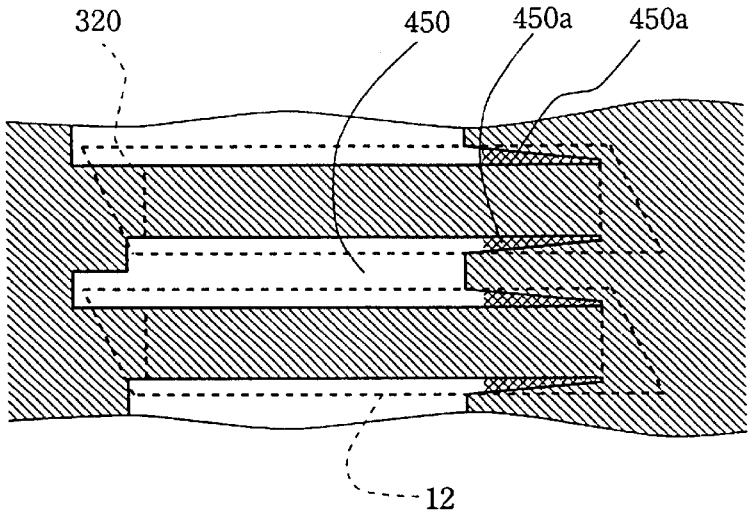
FIGS. 18(*a*) and 18(*b*) are plans of the main part respectively for explaining a thin film manufacturing pattern in the eleventh embodiment of the present invention.
Figure 18B:
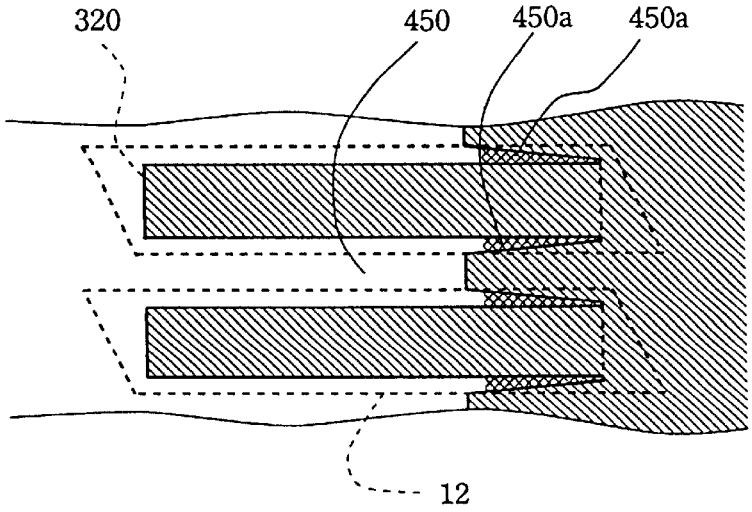

Such a vibration regulating part 355 can be formed by patterning the lower electrode film 60 in a step shown in FIG. 5 (*c*) using a pattern shown in FIG. 18(*a*) for example. In this pattern, an opening 450 is formed in a position opposite to each piezoelectric active part 320, on the side of one end, a narrow part 450*a* extended in parallel with the pressure generating chamber 12, that is, narrowed toward both corners in a position corresponding to the arm of the piezoelectric active part 320 is formed and a thicker resist is left in a narrower part. Hereby, the vibration regulating part 355 which gradually becomes narrower and gradually becomes thicker respectively toward the end as described above, is formed. In a thick part at the end of the vibration regulating part 355, the lower electrode film 60 may be also slightly etched and in any case, the thickness has only to be gradually varied.

Owing to structure provided with the vibration regulating part 355 as described above, as vibration by the application of voltage is regulated in only the vicinity of the end of the piezoelectric active part 320, the displaced quantity is relatively reduced and the displaced quantity at the end can be inhibited without greatly reducing the displaced quantity as a whole, and peeling, a crack etc at the end of the piezoelectric active part 320, and a crack etc in the vicinity of the contact hole 90*a* can be prevented.

In the above embodiments, a step shown in FIG. 5(*b*) for patterning the piezoelectric active part 320 and a step shown in FIG. 5(*c*) for patterning the lower electrode film removed part 350 are executed separately, however, they can be continuously executed using the same resist film. That is, after the piezoelectric active part 320 is patterned using a pattern shown in FIG. 18(*b*) for example, the lower electrode film removed part 350 may be also formed using the same pattern.

A part between the piezoelectric active parts 320 is not required to be all the lower electrode film removed part 350 and for example, an intermediate part provided with the similar constitution of films to the piezoelectric active part 320 may be also formed between adjacent lower electrode film removed parts 350. In this case, the vibration regulating part 355 is formed as described later.

Figure 19A:
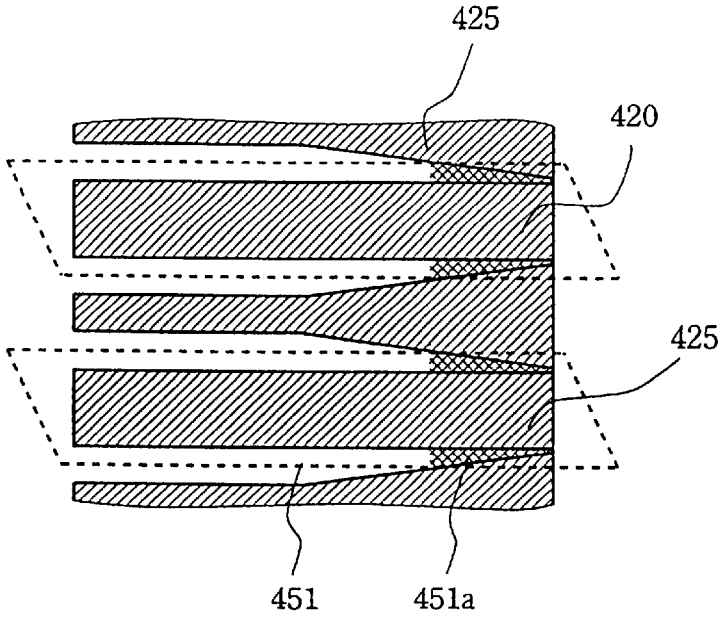
FIGS. 19(*a*) and 19(*b*) are plans of the main part respectively for explaining another thin film manufacturing pattern in the eleventh embodiment of the present invention.
Figure 19B:
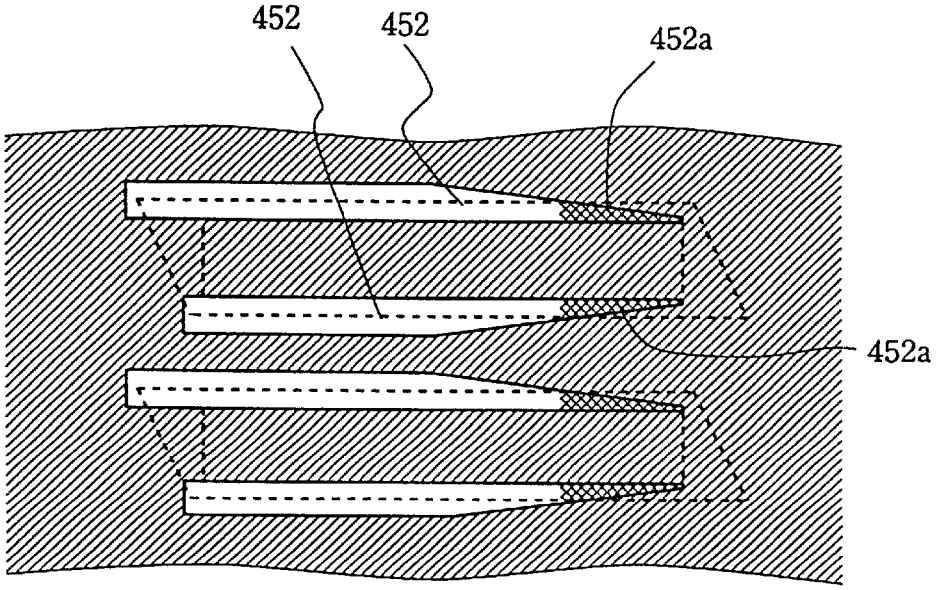

First, the intermediate part is patterned together with the piezoelectric active part 320 using a resist pattern shown in FIG. 19(*a*) in the step shown in FIG. 5(*b*). The resist pattern is provided with a mask part 425 for patterning the intermediate part between mask parts 420 for patterning each piezoelectric active part 320 and one end of the mask part 425 is formed in a wide shape so that the end approaches the mask part 420 for the piezoelectric active part 320. According, the intermediate part provided with a pattern that the intermediate part approaches each piezoelectric active part 320 at one end, can be formed. In the meantime, a narrow part 451a which becomes narrower at the end is formed in an opening 451 adjacent to the wide part of the mask part 420 and thicker resist is left in a narrower part. Therefore, as the piezoelectric film 70 is left in the narrow part 451*a* when the piezoelectric active part 320 is patterned, the above vibration regulating part 355 which gradually becomes narrower and gradually becomes thicker respectively toward the end can be formed by forming the lower electrode film removed part 350 by afterward further etching using the same pattern as described above.

In the above step for removing the lower electrode film, the lower electrode film removed part 350 may be also formed using a resist pattern shown in FIG. 19(*b*). The resist pattern is provided with an opening 452 which becomes narrow at one end. In a narrow part 452*a* at one end of the opening 452, thicker resist is left in a narrower part.

In this case, a wide part is not required to be formed in the mask part 425 shown in FIG. 19(*a*).

In the above structure provided with the vibration regulating part 355, as vibration by the application of voltage is also regulated in only the vicinity of the end of the piezoelectric active part 320 as in the above case, the displaced quantity is also relatively reduced and the displaced quantity at the end can be also inhibited without greatly reducing the displaced quantity as a whole, and peeling, a crack etc at the end of the piezoelectric active part 320 and a crack etc in the vicinity of the contact hole 90*a* can be prevented.

In any case, the lower electrode film removed part 350 may be also provided not only on both sides in the direction of the width of the piezoelectric active part 320 but at the end.

As described above, in this embodiment, when the openings 450 to 452 respectively provided with the narrow parts 450*a* to 452*a* are patterned in a resist film, the resist film which becomes thicker at the end is respectively left in the narrow parts 450*a* to 452*a* and the vibration regulating part 355 is formed utilizing the resist film. The reason why the resist is respectively left in the narrow parts 450*a* to 452*a* as described above is to suitably make adjustment by deteriorating the resolution of patterning and others by widening an interval between a mask and a substrate and others in exposure and as a pattern is difficult to be drawn in a narrow area, a resist film can be left. As a resist is also etched as the upper electrode film 80, the piezoelectric film 70, the lower electrode film 60 and others in dry etching using the pattern if thicker resist is left in a narrower part as described above, a thick part is formed in proportion to the thickness of a resist left part as a result.

Twelfth Embodiment

Figure 20:
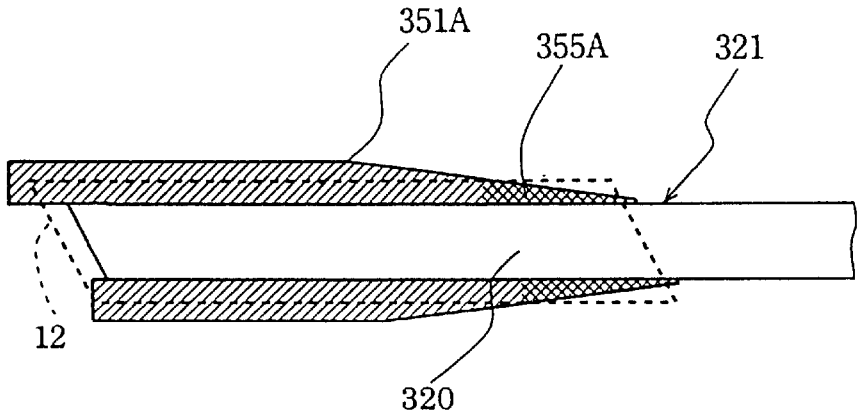
FIG. 20 is a plan showing the main part of an ink-jet recording head equivalent to a twelfth embodiment of the present invention.

FIG. 20 is a plan showing the main part of an ink-jet recording head equivalent to a twelfth embodiment of the present invention.

In this embodiment, a piezoelectric film 70 and an upper electrode film 80 constituting a piezoelectric active part 320 are extended from over one end in the longitudinal direction of a pressure generating chamber 12 up to over its peripheral wall so as to be provided with a connecting part 321 which crosses a boundary between an area opposite to the pressure generating chamber 12 and an area opposite to the peripheral wall and a vibration regulating part 355A of a lower electrode film removed part 350 is formed in the vicinity of the connecting part 321. The vibration regulating part 355A is a vibration regulating part which gradually becomes narrower and gradually becomes thicker as in the eleventh embodiment.

Therefore, owing to such a structure, as in the eleventh embodiment, displacement in the vicinity of the connecting part 321 is regulated and breaking in the vicinity of the connecting part 321 is prevented.

Thirteenth Embodiment

Figure 21A:
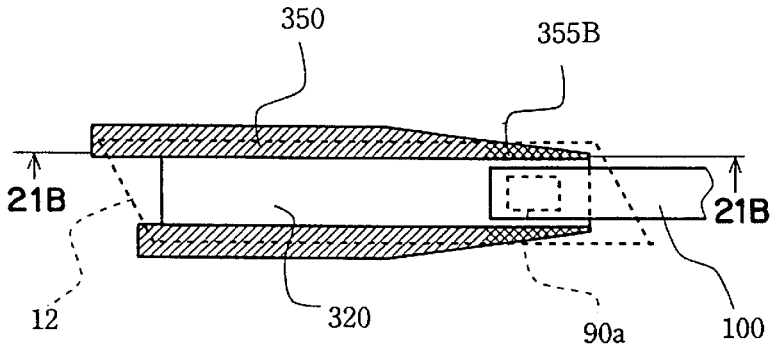
FIGS. 21(*a*) and 21(*b*) are a plan and sectional view respectively showing the main part of an ink-jet recording head equivalent to a thirteenth embodiment of the present invention.
Figure 21B:
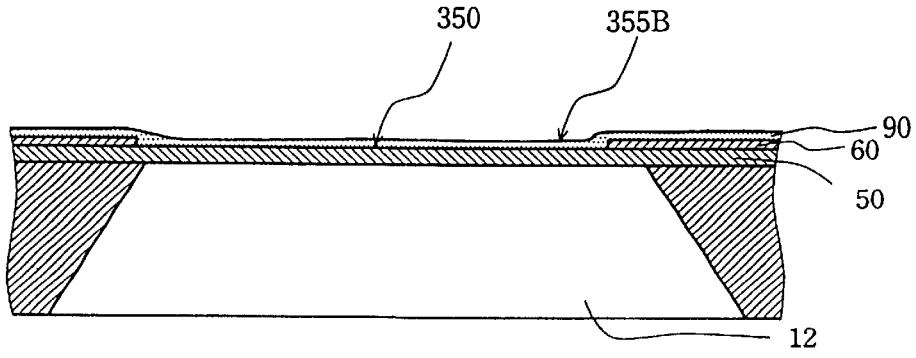

FIGS. 21(*a*) and 21(*b*) are plan showing the main part of an ink-jet recording head equivalent to a thirteenth embodiment of the parents invention and a sectional view viewed along a line 21B—21B.

In this embodiment, a vibration regulating part 355B at one end of a lower electrode film removed part 350 gradually becomes narrower toward the end, however, the thickness is unchanged. Such structure can be formed by completely removing resist in the narrow part 450a in the opening 450 shown in FIGS. 18.

In this case, vibration in the vibration regulating part 355B is also regulated as in the eleventh embodiment and breaking etc in the vicinity of the vibration regulating part 355B is prevented.

Fourteenth Embodiment

Figure 22A:
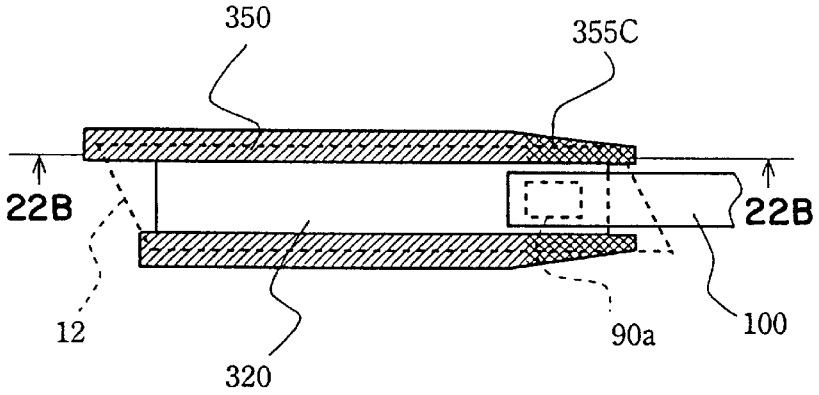
FIGS. 22(*a*) and 22(*b*) are a plan and a sectional view respectively showing the main part of an ink-jet recording head equivalent to a fourteenth embodiment of the present invention.
Figure 22B:
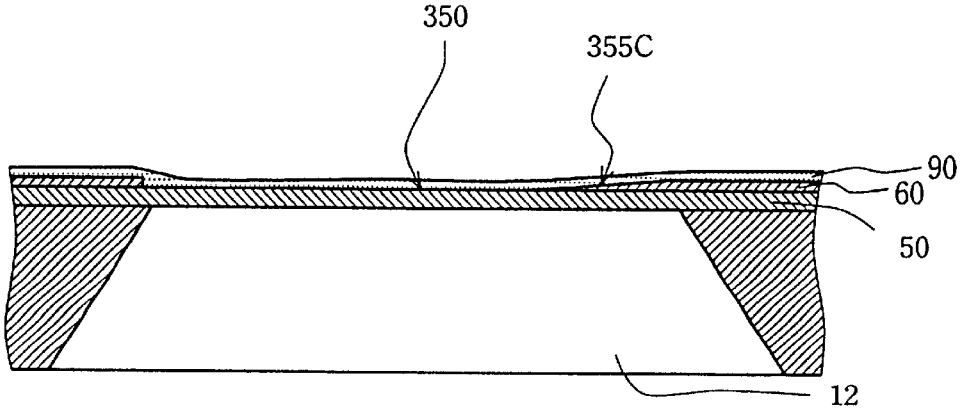

FIGS. 22(*a*) and 22(*b*) are a plan showing the main part of an ink-jet recording head equivalent fourth embodiment of the present invention and a sectional view viewed along a line 22B—22B.

In this embodiment, a vibration regulating part 355C at one end of a lower electrode film removed part 350 gradually becomes thicker toward the end, however, the width is unchanged in an area opposite to a pressure generating chamber 12 and directly related to the regulation of vibration. Such a structure can be also similarly formed using a resist pattern provided with an opening which becomes narrower toward the end as described above. In this case, the width of the end is equal to the width from the end in the direction of the width of a piezoelectric active part 320 to the edge of the pressure generating chamber 12 or wider.

In this case, vibration in the vibration regulating part 355C is also similarly regulated as in the eleventh embodiment and breaking etc in the vicinity of the vibration regulating part 355C are prevented.

In such structure, the width of an opening in a part corresponding to the vibration regulating part 355C is unchanged. However, a mask provided with an opening in which a resist film gradually becomes thicker toward the end can be also formed by gradually laminating thin resist layers for example.

Fifteenth Embodiment

Figure 23A:
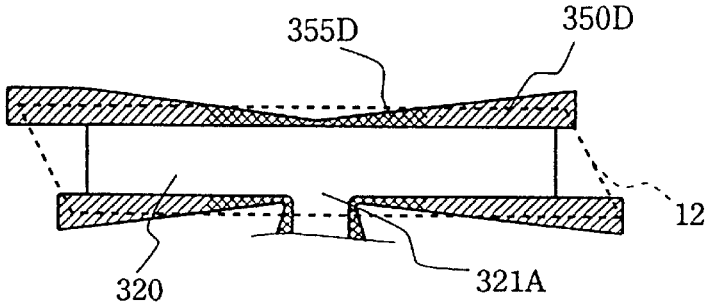
FIGS. 23(*a*) and 23(*b*) are plans respectively showing the main part of an ink-jet recording head equivalent to a fifteenth embodiment of the present invention.
Figure 23B:
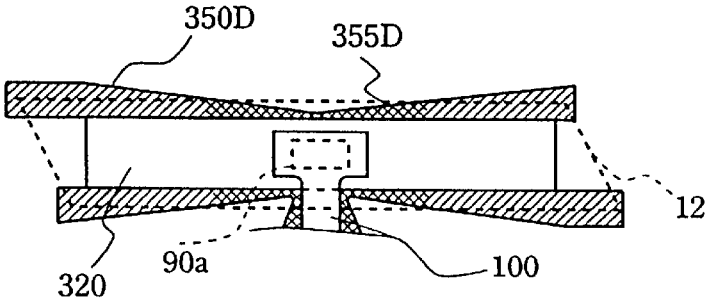

FIGS. 23 are plans showing the main part of an ink-jet recording head equivalent to a fifteenth embodiment of the present invention.

This embodiment is an example in which a vibration regulating part 355D is provided approximately in the center of a piezoelectric active part 320. If a connecting part 321A is provided approximately in the center of the piezoelectric active part 320 as shown in FIG. 23(*a*), the vibration regulating part 355D may be also provided in the vicinity of the connecting part 321A. The vibration regulating part 355D is formed on both sides in the direction of the width of the piezoelectric active part 320 in the vicinity of the connecting part 321A and on both sides of the connecting part 321A.

If a contact hole 90*a* is provided approximately in the center of the piezoelectric active part 320 as shown in FIG. 23(*b*), the vibration regulating part 355D may be also provided in the vicinity of the contact hole 90*a*, that is, on both sides in the center of the piezoelectric active part 320 and on both sides of a lead electrode 100.

In this embodiment, a lower electrode film removed part 350 is provided on both sides of the piezoelectric active part 320 as in the eleventh embodiment and the vibration regulating part 355D is formed by changing the width and the thickness of a lower electrode film 60 so that the width gradually becomes narrower and the thickness gradually becomes thicker respectively toward approximately the center of the piezoelectric active part 320 and the vibration of a diaphragm is regulated in the center.

Therefore, in this case, vibration in the vibration regulating part 355D is also regulated as in the eleventh embodiment and breaking and others in the vicinity of the vibration regulating part 355D are prevented.

Sixteenth Embodiment

Figure 24A:
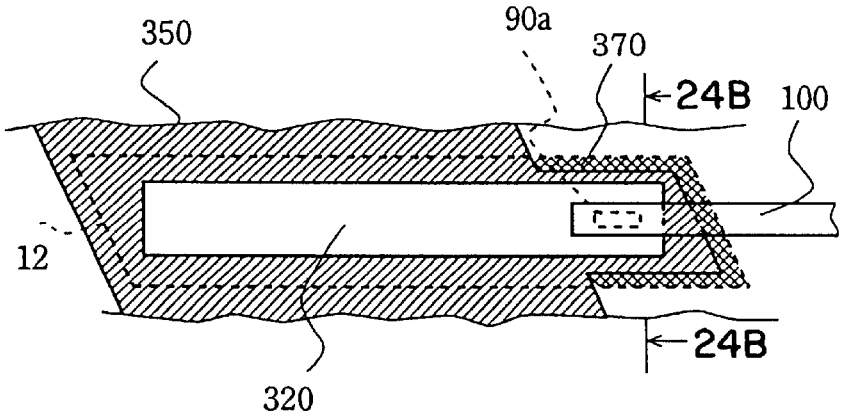
FIGS. 24(*a*) and 24(*b*) are a plan and a sectional view respectively showing the main part of an ink-jet recording head equivalent to a sixteenth embodiment of the present invention.
Figure 24B:
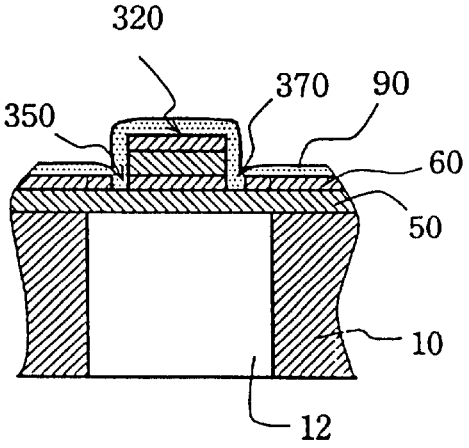

FIGS. 24 show a planar positional relationship among a piezoelectric active part 320, a lower electrode film removed part 350 and a pressure generating chamber 12 of an ink-jet recording head equivalent to a sixteenth embodiment and a section. As a basic constitution is similar to that in the first embodiment, the same reference number is allocated to a member showing the same action and the description is omitted.

As shown in FIG. 24(*a*), the piezoelectric active part 320 composed of a piezoelectric film 70 and an upper electrode film 80 is provided in an area opposite to the pressure generating chamber 12 and formed so that the width of the piezoelectric active part is slightly narrower than that of the pressure generating chamber 12. An insulating layer 90 and a lead electrode 100 are formed on the upper electrode film 80 and a contact hole 90a for connecting the lead electrode 100 and the upper electrode film 80 is formed in the insulating layer 90 corresponding to one end of the piezoelectric active part 320.

The lower electrode film removed part 350 is formed opposite to the vicinity of a boundary with the peripheral wall of the pressure generating chamber 12 and in an area surrounding the piezoelectric active part 320.

The other part of an area opposite to the pressure generating chamber 12, that is, a thick part 370 relatively than the lower electrode film removed part 350 is formed in an area oppsite to the edge of the pressure generating chamber 12 and in the vicinity of the end of the piezoelectric active part 320 near the contact hole 90*a* as shown in a section viewed along a line 24B—24B in FIG. 24(*b*). In this embodiment, the thick part 370 is formed by leaving the lower electrode film 60 without removing it. That is, when the lower electrode film removed part 350 is formed in the step shown in FIG. (*c*), the lower electrode film 60 in this part is left.

Owing to such a constitution, when voltage is applied to the piezoelectric active part 320 to drive it, the vibration of a diaphragm in the vicinity of the contact hole 90*a* is regulated by the thick part 370 and the breaking and others of the piezoelectric active part 320 can be prevented. Also, the durability of the diaphragm in an area opposite to the inside of a boundary between the pressure generating chamber 12 and the peripheral wall is enhanced by the thick part 370. Particularly, in case the rigidity of the diaphragm is deteriorated by forming the lower electrode film removed part 350 around the piezoelectric active part 320 as in this embodiment, the thick part is effective.

In this embodiment described above, the lower electrode film removed part 350 is formed around the piezoelectric active part 320 and the thick part 370 is formed by only the lower electrode film 60. However, the present invention is not limited to this. The thick part 370 has only to be formed so that it is relatively thicker than the other part in the area opposite to the pressure generating chamber 12 as described above, for example, not only the lower electrode film 60 but the piezoelectric film 70 and the upper electrode film 80 may be also left and also for example, the thick part 370 thicker than the other part may be also formed by laminating another layer such as an insulating layer on the lower electrode film 60 or an elastic film 50 from which the lower electrode film 60 is removed.

Further, the lower electrode film removed part 350 is not necessarily required to be formed and the thick part 370 in this case has only to be formed so that the thick part is relatively thicker than the other part by leaving the piezoelectric film 70, and further, the upper electrode film 80 on the lower electrode film 60 for example, or by laminating another layer such as an insulating layer on the lower electrode film 60 for example.

Seventeenth Embodiment

Figure 25:
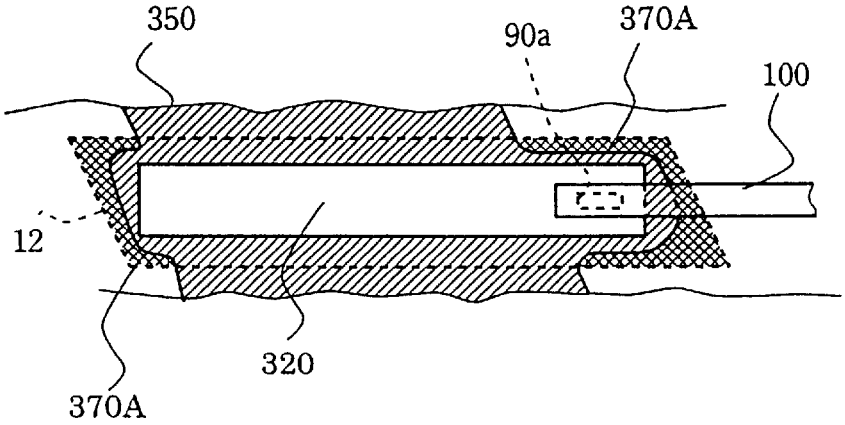
FIG. 25 is a plan showing the main part of an ink-jet recording head equivalent to a seventeenth embodiment of the present invention.

FIG. 25 shows a planar positional relationship among a piezoelectric active part 320, a lower electrode film removed part 350 and a pressure generating chamber 12 in a seventeenth embodiment.

This embodiment is the same as the sixteenth embodiment except that the inner edge of a thick part 370A formed in an area opposite to the corner of the pressure generating chamber 12 is formed by a curve as shown in FIG. 25. In this embodiment, the similar thick part 370A is also provided at the corner of the other end of the pressure generating chamber 12.

Owing to such a constitution, a similar effect to that in the sixteenth embodiment can be produced and the durability of a diaphragm in the vicinity of a boundary with the other end of the pressure generating chamber 12 is enhanced. Further, as the inner edge of the thick part 370A is formed by a curve to remove corners, a crack can be effectively prevented from being caused in a diaphragm at the corner.

Eighteenth Embodiment

Figure 26:
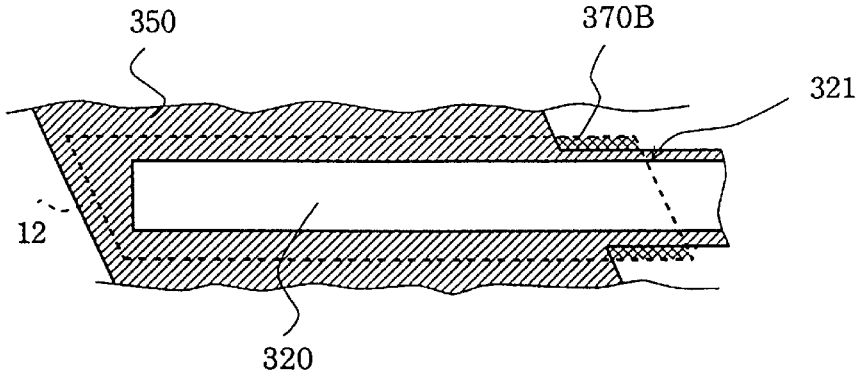
FIG. 26 is a plan showing the main part of an ink-jet recording head equivalent to an eighteenth embodiment of the present invention.

FIG. 26 shows a planar positional relationship among a piezoelectric active part 320, a lower electrode film removed part 350 and a pressure generating chamber 12 in an eighteenth embodiment.

This embodiment is the same as the sixteenth embodiment except that a piezoelectric film 70 and an upper electrode film 80 constituting the piezoelectric active part 320 are continuously extended from an area opposite to the pressure generating chamber 12 to an area opposite to its peripheral wall and a contact part with a lead electrode 100 and the upper electrode film 80 is provided to an area opposite to the peripheral wall.

That is, as shown in FIG. 26, the piezoelectric active part 320 is basically provided in the area opposite to the pressure generating chamber 12, at one end of the pressure generating chamber 12, the piezoelectric film 70 and the upper electrode film 80 are extended to the area opposite to the peripheral wall, a connecting part 321 is provided in the vicinity of a boundary with the area opposite to the pressure generating chamber 12 and a thick part 370B is formed in the vicinity of the connecting part 321. The thick part 370B is formed by leaving a lower electrode film 60 for example as in the above embodiments.

Owing to such a constitution, vibration at the end in the vicinity of the connecting part 321 of the piezoelectric active part 320B is inhibited by the thick part 370B as in the sixteenth embodiment and the breaking etc of a diaphragm can be prevented. Needless to say, the thick part 370B may be also provided at the other end of the pressure generating chamber 12.

Nineteenth Embodiment

Figure 27:
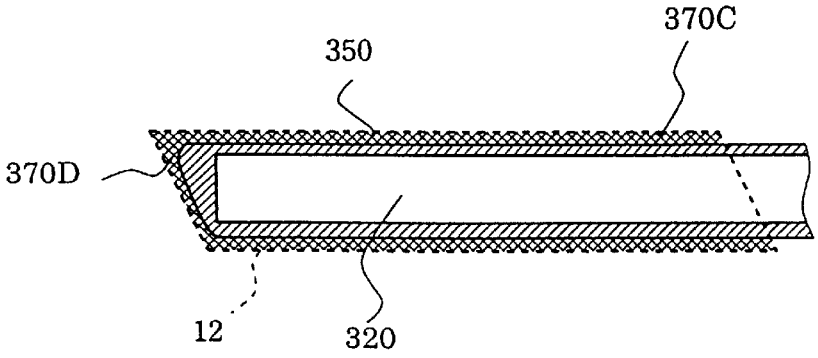
FIG. 27 is a plan showing the main part of an ink-jet recording head equivalent to a nineteenth embodiment of the present invention.

FIG. 27 shows a planar positional relationship among a piezoelectric active part 320, a lower electrode film removed part 350 and a pressure generating chamber 12 in a nineteenth embodiment.

This embodiment is the same as the eighteenth embodiment except that the lower electrode film removed part 350 is formed in the shape of a groove along the piezoelectric active part 320 as shown in FIG. 27, a thick part 370C is provided in a longitudinal direction in an area opposite to a boundary with the peripheral wall on both sides in the direction of the width of the pressure generating chamber 12 and further, a thick part 370D the inner edge of which is formed by a curve is provided so that the end of the piezoelectric active part 320 over the pressure generating chamber 12 is surrounded.

Therefore, owing to such a constitution, the breaking and others of a diaphragm in an area opposite to a boundary with the peripheral wall of the pressure generating chamber 12 can be prevented by the thick parts 370C and 370D.

Other Embodiments

Each embodiment of the present invention is described above. However, the basic constitution of the ink-jet recording head is not limited to the above one.

For example, the common ink chamber forming plate 30 may be also formed by glass ceramics in addition to the above sealing plate 20, further, the thin film 41 may be also formed by glass ceramics as another member and the material, the structure and others may be freely varied.

In the above embodiments, the nozzle aperture is formed on the end face of the passage forming substrate 10. However, a nozzle aperture connected in a direction perpendicular to the face may be also formed.

Figure 28:
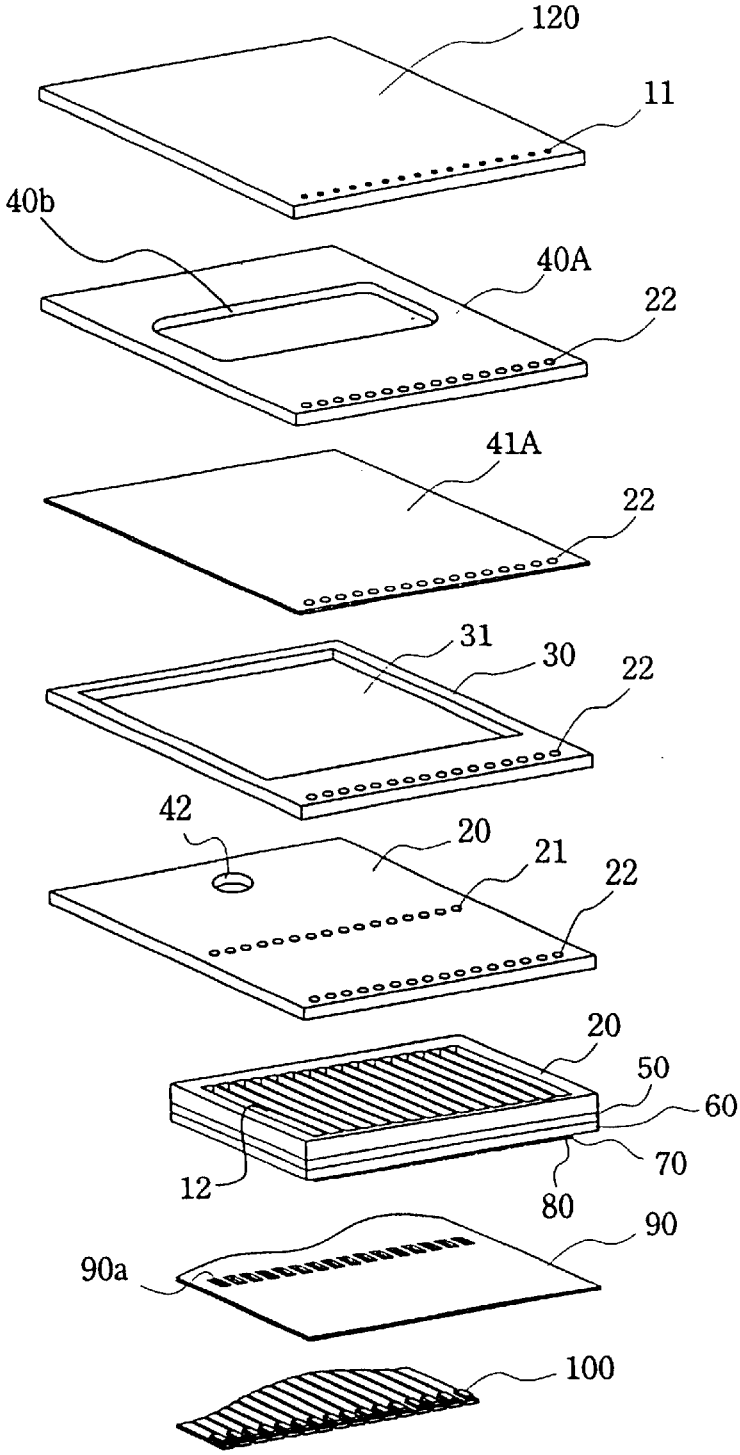
FIG. 28 is an exploded perspective view showing an ink-jet recording head equivalent to the other embodiment of the present invention.
Figure 29:
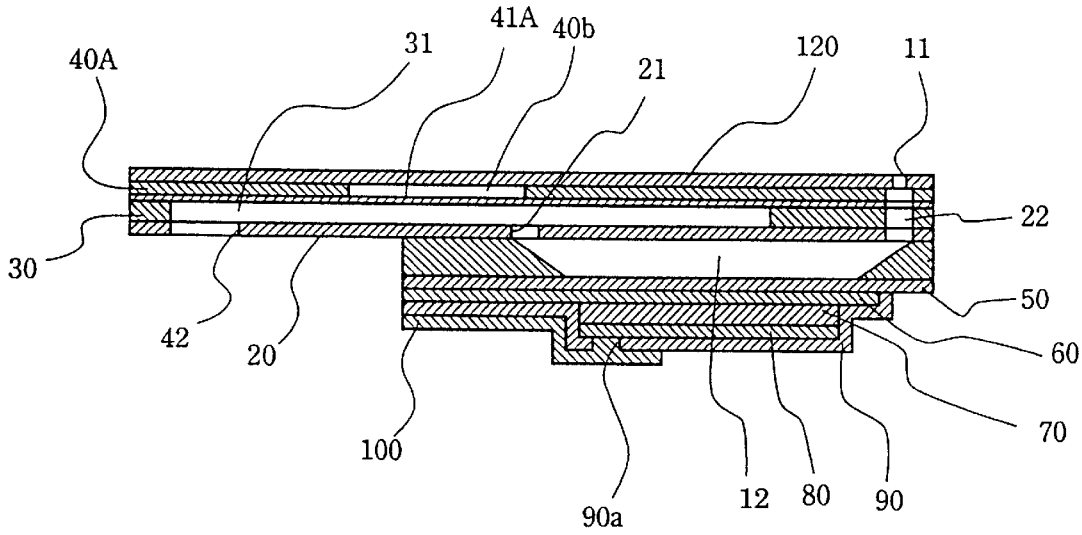
FIG. 29 is a sectional view showing the ink-jet recording head equivalent to the other embodiment of the present invention.

FIGS. 28 and 29 are respectively an exploded perspective view showing an embodiment constituted as described above and a sectional view showing the passage. In this embodiment, a nozzle aperture 11 is made in a nozzle substrate 120 on the reverse side to a piezoelectric element and a nozzle communicating port 22 connecting the nozzle aperture 11 and a pressure generating chamber 12 pierces a sealing plate 20, a common ink chamber forming plate 30, a thin plate 41A and an ink chamber side plate 40A.

This embodiment is basically the same as the above embodiments except that the thin plate 41A and the ink chamber side plate 40A are formed separately and an opening 40*b* is formed in the ink chamber side plate 40, the same reference number is allocated to the same member and the description is omitted.

In this embodiment, as in the first to the nineteenth embodiments, a vibration regulating part is also provided, vibration in a piezoelectric active part is partially regulated, and peeling and a crack at both ends of a piezoelectric film can be prevented.

Needless to say, more effect is produced by suitably combining the above embodiments.

In the above embodiments, the thin film-type ink-jet recording head which can be manufactured by applying processes for forming films and lithography is described as an example. However, needless to say, the present invention is not limited to this and the present invention can be applied to ink-jet recording heads provided with various structure such as a type in which a pressure generating chamber is formed by laminating substrates, a type in which a piezoelectric film is formed by sticking a green sheet, screen printing and others and a type in which a piezoelectric film is formed by crystal growth.

The example in which the insulating layer is provided between the piezoelectric element and the lead electrode is described. However, the present invention is not limited to this, for example, an anisotropic conductive film may be also thermally welded to each upper electrode without providing an insulating layer and connected to a lead electrode, and may be also connected using various bonding technique such as wire bonding.

As described above, the present invention can be applied to ink-jet recording heads provided with various structures unless the object is violated.

Figure 30:
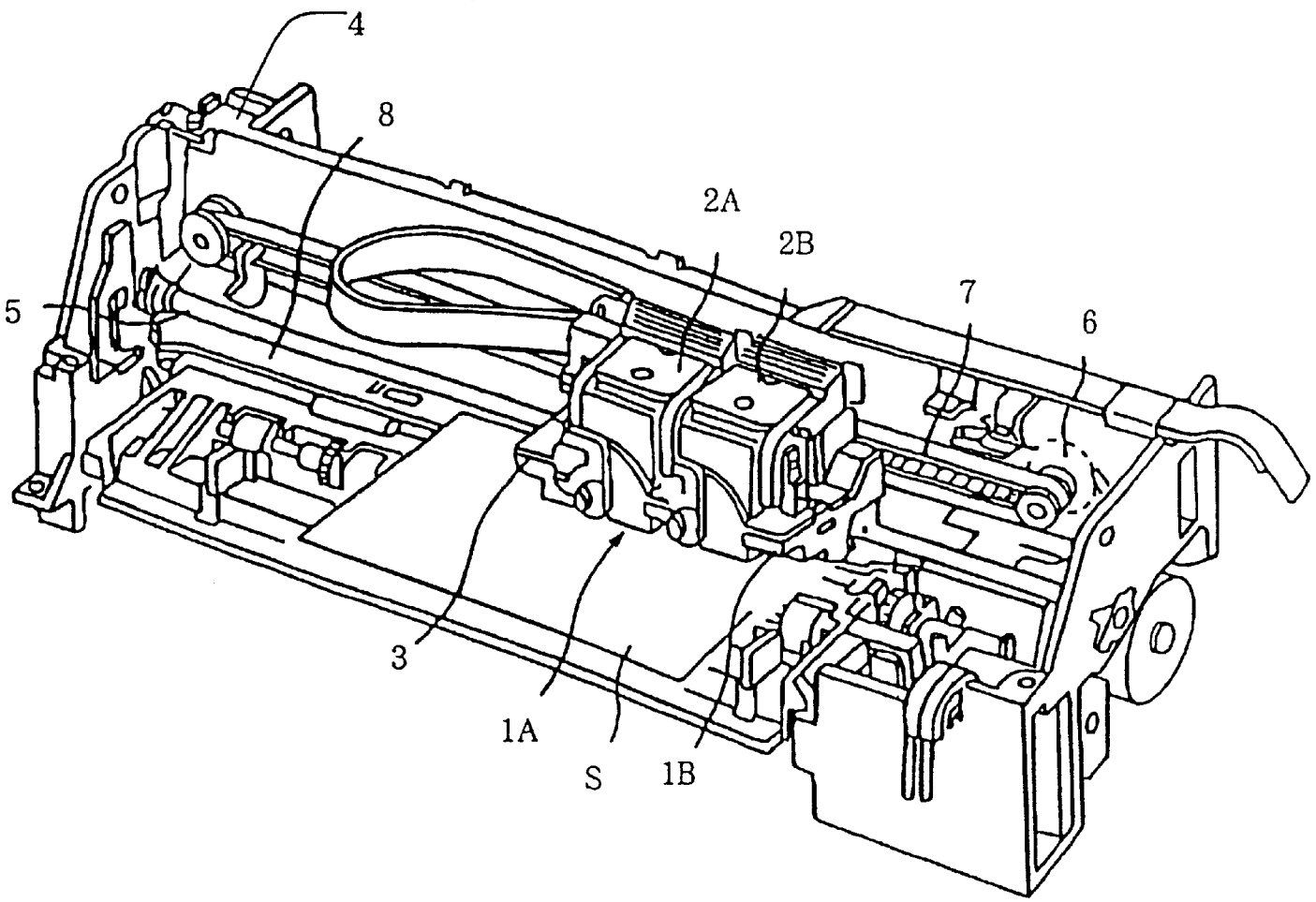
FIG. 30 is a schematic drawing showing an ink-jet recording device equivalent to an embodiment of the present invention.

The ink-jet recording heads equivalent to these embodiments respectively constitute a part of a recording head unit provided with an ink passage communicating with an ink cartridge and others and are respectively mounted in an ink-jet recording device. FIG. 30 is a schematic drawing showing an example of the ink-jet recording device.

As shown in FIG. 30, cartridges 2A and 2B respectively constituting ink supply means are respectively provided on recording head units 1A and 1B respectively provided with an ink-jet recording head so that the cartridges can be respectively detached and a carriage 3 mounting these recording head units 1A and 1B is provided to a carriage shaft 5 attached to the body 4 of the device so that the carriage can be moved axially. These recording head units 1A and 1B respectively jet a black ink composition and a color ink composition.

The driving force of a driving motor 6 is transmitted to the carriage 3 via plural gears not shown and a timing belt 7 and the carriage 3 mounting the recording head units 1A and 1B is moved along the carriage shaft 5. In the meantime, a platen 8 is provided along the carriage shaft 5 in the body 4 of the device and a recording sheet S which is a recording medium such as paper fed by a paper feeding roller not shown and others is wound on the platen 8 and carried.

A described above, according to the present invention, vibration is partially regulated by providing the vibration regulating part for regulating vibration in a part of the piezoelectric active part opposite to the pressure generating chamber, and a crack or peeling at both ends of the piezoelectric active part etc can be prevented without greatly reducing the whole displaced quantity.

What is claimed is:

1. An ink-jet recording head comprising:

a diaphragm constituting a part of a pressure generating chamber communicating with a nozzle aperture, a piezoelectric element formed on said diaphragm, a piezoelectric active part of said piezoelectric element provided in an area opposite to said pressure generating chamber, and a vibration regulating part for partially regulating vibration in at least a part of said diaphragm in a vicinity of a boundary with a peripheral wall of said pressure generating chamber.

2. An ink-jet recording head according to claim 1, wherein said diaphragm comprises a thin part thinner than a thickness of a part corresponding to said piezoelectric active part at least in a part along an edge of said pressure generating chamber on both sides in a direction of a width of said piezoelectric active part.

3. An ink-jet recording head according to claims 1 or 2, wherein, said vibration regulating part is provided outside in a longitudinal direction and on both sides of an end of said piezoelectric active part.

4. An ink-jet recording head according to claims 1 or 2, wherein said vibration regulating part is provided in a part of both sides in the direction of the width of said piezoelectric active part.

5. An ink-jet recording head according to claims 1 or 2, wherein a piezoelectric layer and an upper electrode constituting said piezoelectric active part are continuously provided from an end in a longitudinal direction of said piezoelectric active part to an area opposite to the peripheral wall of said pressure generating chamber and constitute a connecting part and said vibration regulating part is a vibration regulating layer laminated at least on said piezoelectric active part in a vicinity of a following end on a side on which at least said connecting part is provided at an end in a longitudinal direction of said pressure generating chamber for regulating a vibration of said diaphragm.

6. An ink-jet recording head according to claim 5, wherein an insulating layer laminated so that a vicinity of at least the end in the longitudinal direction of said pressure generating chamber is covered, constitutes said vibration regulating layer.

7. An ink-jet recording head according to claim 6, wherein a layer provided at least on said connecting part of said piezoelectric active part constitutes said vibration regulating layer.

8. An ink-jet recording head according to claim 5, wherein a layer provided at least on said connecting part of said piezoelectric active part constitutes said vibration regulating layer.

9. An ink-jet recording head according to claim 8, wherein said vibration regulating layer is constituted by thickening a thickness of said upper electrode film, compared with that of the area opposite to the peripheral wall of the pressure generating chamber.

10. An ink-jet recording head according to claim 5, wherein, in said connecting part, both said piezoelectric layer and said upper electrode are formed so that they are narrower than a main part of said piezoelectric active part.

11. An ink-jet recording head according to claim 5, wherein, in said connecting part, only said upper electrode is formed so that it is narrower than a main part of said piezoelectric active part.

12. An ink-jet recording head according to claim 5, wherein a contact for connecting a lead electrode for applying voltage to said piezoelectric active part and said upper electrode is provided in a part opposite to the peripheral wall of said pressure generating chamber.

13. An ink-jet recording head according to claim 1, wherein said vibration regulating part is provided with another layer for regulating vibration of said vibration regulating part.

14. An ink-jet recording head according to claim 1, wherein said vibration regulating part is provided with an inactive part provided with an inactive piezoelectric layer on said diaphragm.

15. An ink-jet recording head according to claim 14, wherein said inactive part is one of a part in which an upper electrode on a piezoelectric layer constituting said piezoelectric element is removed and a part in which the upper electrode is provided on the piezoelectric layer via an insulating layer.

16. An ink-jet recording head according to claim 1, wherein said vibration regulating part is provided in at least a part of an inner edge of a boundary between said pressure generating chamber and the peripheral wall; and said vibration regulating part is a thick part a whole thickness of which is thicker than a whole thickness around said piezoelectric active part.

17. An ink-jet recording head according to claim 16, wherein said thick part is provided on both sides in a direction of a width of said piezoelectric active part.

18. An ink-jet recording head according to claims 16 or 17, wherein an inner edge of said thick part provided at a corner of said pressure generating chamber is curved.

19. An ink-jet recording head according to claim 16, wherein said thick part is composed of said diaphragm, said piezoelectric layer and an upper electrode disposed on said piezoelectric layer.

20. An ink-jet recording head according to claim 16, wherein said thick part is composed of said diaphragm and another layer.

21. An ink jet recording head according to claim 16, wherein said thick part is composed of said diaphragm.

22. An inkjet recording head according to claim 16, wherein the periphery of said piezoelectric active part is substantially composed of said diaphragm.

23. An ink-jet recording head according to claim 16, wherein around said piezoelectric active part, the thickness of said diaphragm is substantially relatively thinned.

24. An ink-jet recording head according to claim 23, wherein said diaphragm is composed of an elastic film and a lower electrode; and a periphery of said piezoelectric active part is composed of only said elastic film.

25. An ink-jet recording head according to claim 1, wherein a piezoelectric layer and an upper electrode constituting said piezoelectric active part are continuously provided from an end in a longitudinal direction of said piezoelectric active part to an area opposite to the peripheral wall of said pressure generating chamber and constitute a connecting part; and said vibration regulating part is provided at least in a vicinity of said connecting part of said pressure generating chamber.

26. An ink-jet recording head according to claim 25, wherein said connecting part is provided to the end in the longitudinal direction of said pressure generating chamber.

27. An ink-jet recording head according to claim 1, wherein said piezoelectric active part is provided in an area opposite to said pressure generating chamber apart from the peripheral wall and provided with a contact which functions as a connection between a lead electrode for applying voltage to said piezoelectric active part and said piezoelectric active part in an area opposite to said pressure generating chamber and said vibration regulating part is provided at least in a vicinity of said contact of said pressure generating chamber.

28. An ink-jet recording head according to claim 27, wherein said contact is provided in a vicinity of an end in a longitudinal direction of said pressure generating chamber.

29. An ink-jet recording head according to claims 27 or 28, wherein an insulating layer is formed on an upper surface of said piezoelectric active part; and said contact is formed in a contact hole formed in said insulating layer.

30. An ink-jet recording head according to claim 1, wherein said pressure generating chamber is formed by anisotropically etching a silicon monocrystalline substrate; and each layer of said piezoelectric element is formed by a film forming method and lithography.

31. An ink-jet recording head according to claim 2, wherein said vibration regulating part is provided outside in a longitudinal direction of an end of said piezoelectric active part; and said diaphragm on both sides of said vibration regulating part is said thin part.

32. An ink-jet recording head according to claim 2, wherein said vibration regulating part is a thick part in which said diaphragm is thicker than said thin part.

33. An ink-jet recording head according to claim 2, wherein said vibration regulating part is provided in a part of an arm along the edge of said pressure generating chamber on both sides in the direction of the width of said piezoelectric active part; and a vibration of said diaphragm is regulated by gradually varying a thickness of said arm.

34. An ink-jet recording head according to claim 2, wherein said vibration regulating part is provided in a part of an arm along the edge of said pressure generating chamber on both sides in the direction of the width of said piezoelectric active part; and a vibration of said diaphragm is regulated by gradually varying a width of said arm.

35. An ink-jet recording head according to claim 2, wherein said vibration regulating part is provided in a part of an arm along the edge of said pressure generating chamber on both sides in the direction of the width of said piezoelectric active part; and a vibration of said diaphragm is regulated by gradually varying a thickness and a width of said arm.

36. An ink-jet recording head according to claims 34 or 35, wherein the width of said arm is equivalent to a distance from an end in the direction of the width of said piezoelectric active part to a thick part which is provided between adjacent piezoelectric active parts and a thickness of which is thicker than that of said arm.

37. An ink-jet recording head according to claim 36, wherein said diaphragm is composed of an elastic film and a lower electrode provided on said elastic film, said arm is essentially composed of only said elastic film, said vibration regulating part is further provided with said lower electrode; and a variation of a thickness of said vibration regulating part is equivalent to a variation of a thickness of said lower electrode.

38. An ink-jet recording head according to any one of claims 33 to 35, wherein said diaphragm includes an elastic film and a lower electrode provided on said elastic film; said arm is essentially composed of said elastic film and said lower electrode; and a variation of a thickness of said vibration regulating part is equivalent to a variation of a thickness of said piezoelectric layer.

39. An ink-jet recording head according to claim 38, wherein said diaphragm includes an elastic film and a lower electrode provided on said elastic film; said arm is essentially composed of said elastic film and said lower electrode; and a variation of a thickness of said vibration regulating part is equivalent to a variation of a thickness of said piezoelectric layer.

40. An ink-jet recording head according to any one of claims 33 to 35, wherein said diaphragm is composed of an elastic film and a lower electrode provided on said elastic film, said arm is essentially composed of only said elastic film, said vibration regulating part is further provided with said lower electrode; and a variation of a thickness of said vibration regulating part is equivalent to a variation of a thickness of said lower electrode.

41. An ink-jet recording head according to claim 38, wherein said diaphragm is composed of an elastic film and a lower electrode provided on said elastic film, said arm is essentially composed of only said elastic film, said vibration regulating part is further provided with said lower electrode; and a variation of a thickness of said vibration regulating part is equivalent to a variation of a thickness of said lower electrode.

42. An ink-jet recording device, comprising:

an ink-jet recording head including:

a diaphragm constituting a part of a pressure generating chamber communicating with a nozzle aperture, a piezoelectric element formed on said diaphragm, a piezoelectric active part of said piezoelectric element provided in an area opposite to said pressure generating chamber, and a vibration regulating part for partially regulating vibration in at least a part of said diaphragm in a vicinity of a boundary with a peripheral wall of said pressure generating chamber.

* * * * *